US007239300B2

(12) United States Patent
Shimizu

(10) Patent No.: US 7,239,300 B2
(45) Date of Patent: Jul. 3, 2007

(54) DRIVING APPARATUS AND DISPLAY MODULE

(75) Inventor: Yukihiro Shimizu, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 555 days.

(21) Appl. No.: 10/805,422

(22) Filed: Mar. 22, 2004

(65) Prior Publication Data

US 2004/0189579 A1 Sep. 30, 2004

(30) Foreign Application Priority Data

Mar. 28, 2003 (JP) ..... 2003-092449

(51) Int. Cl.
*G09G 3/36* (2006.01)
*G09G 5/02* (2006.01)

(52) U.S. Cl. ..... 345/100; 345/98; 345/204; 345/211

(58) Field of Classification Search ..... 345/55, 345/87, 88, 98, 100, 204, 208, 211, 690
See application file for complete search history.

(56) References Cited

U.S. PATENT DOCUMENTS 6,476,789 B1 * 11/2002 Sakaguchi et al. ..... 345/100
6,603,466 B1 * 8/2003 Sakaguchi et al. ..... 345/204
6,664,943 B1 * 12/2003 Nakajima et al. ..... 345/98
6,697,041 B1 * 2/2004 Tamai et al. ..... 345/100
6,756,959 B2 * 6/2004 Fujino ..... 345/95

FOREIGN PATENT DOCUMENTS

JP 08-022267 1/1996
JP 2747583 2/1998

* cited by examiner

*Primary Examiner*—Richard Hjerpe
*Assistant Examiner*—My-Chau T. Tran
(74) *Attorney, Agent, or Firm*—Harness, Dickey & Pierce, P.L.C.

(57) ABSTRACT

A source driver includes a hold memory circuit and a switch circuit. The hold memory circuit includes (i) delay circuits for delaying an inputted horizontal synchronization signal, (ii) hold latch cells each for latching display data in accordance with the horizontal synchronization signal that has been delayed by the delay circuit, and (iii) a control circuit for outputting a display start signal to the switch circuit upon receipt of the horizontal synchronization signal that has been delayed by the delay circuit. The switch circuit outputs a plurality of driving signals in accordance with the display start signal. This allows the peak value of the power source current to be reduced, and enables to avoid the malfunction of the source driver due to the misidentification of the horizontal synchronization signal and to avoid that the output timing becomes nonuniform.

17 Claims, 17 Drawing Sheets

24
LS
34
34
31
CONTROL CIRCUIT
CTRB-LS
CTSB-LS
LSOUT
SIGNAL FLOW
SIGNAL FLOW
Right-LS
Left-LS
DELAY CIRCUIT
32
33
HOLD LATCH CELL
LSOUT
X1
Y1
Z1
B
X100
Y100
Z100

D
Q
CK
HOLD LATCH CELL
DISPLAY DATA
LS
X1
33

DRIVING APPARATUS AND DISPLAY MODULE

This nonprovisional application claims priority under 35 U.S.C. § 119(a) on Patent Application No. 2003-92449 filed in Japan on Mar. 28, 2003, the entire contents of which are hereby incorporated by reference.

FIELD OF THE INVENTION

The present invention relates to a driving apparatus that drives a display module for displaying an image in accordance with a display data which has been subject to an digital to analog conversion, and relates to a display module including the driving apparatus.

BACKGROUND OF THE INVENTION

A liquid crystal panel (a liquid crystal display panel) has been in heavy usage in a display (a display module such as a liquid crystal display apparatus) such as a PC (personal computer) or a TV (television).

The following description deals with one example of driving circuits that drive a liquid crystal panel.

FIG. 13 is a block diagram showing a configuration of an X driver (a source driver) for supplying source lines with signals. The X-driver is one of the driving circuits. The technique relating to this kind of circuit is disclosed in Japanese examined patent publication No. 2747583 (publication date: Dec. 12, 1998), for example.

FIG. 14 is a time chart showing how main signals such as input signals, internal signals, and output signals behave during driving of the X-driver shown in FIG. 13.

As shown in FIG. 13, the X-driver includes a shift register 101, a latch A-circuit 102, a latch B-circuit 103, a decoder 104, a level shifter 105, and an analog switch group 106.

The shift register 101 receives a clock signal XCL and a start pulse (an input signal) XSP (see FIG. 14). The shift register 101 supplies internal output signals Q1 through QM to corresponding stages of the latch A-circuit 102, respectively. In FIG. 14, an internal output signal Qa indicates a signal which is outputted from the a-th stage of the shift register 101.

Symbols PD1 through PD4 indicate an input signal to be supplied to the first stage of the latch A-circuit 102. The input signal is a 4-bit digital signal.

The latch A-circuit 102 latches K-bit (here, K=4) signal PD1 through PD4 in parallel, and then outputs signals QA1 through QAM. Note that the signal QAa indicates a signal outputted from the a-th ($1 \leqq a \leqq M$) stage of the latch A-circuit 102.

Namely, the latch A-circuit 102 sweeps the 4-bit data PD1 through PD4 in response to each rising edge of the output signals from the shift register 101 so as to output the signals QA1 through QAM.

The latch B-circuit 103 receives a latch clock input signal LCL. The latch B-circuit 103 sweeps the output signal QAa ($1 \leqq a \leqq M$) of the latch A-circuit 102 in response to each falling edge of the latch clock input signal LCL so as to output a signal QB (4-bit signal DI1 through DI4).

The decoder 104 receives and decodes the 4-bit signal DI1 through DI4 so as to generate 16 data DO0 through DO15.

The level shifter 105 boosts the output signals of the decoder 104 up to a level of a liquid crystal driving voltage.

The analog switch group 106 supplies the output signals of the level shifter 105 to control terminals of respective analog switches so as to select one of $16(=2^4)$-level gradation signals.

Note that each stage of the latch A-circuit 102 includes four (4) half-latch circuits 107, and that each stage of the latch B-circuit 103 includes four (4) half-latch circuits 108.

Each stage of the latch A-circuit 102 latches a 4-bit PD1 through PD4 in sync with an output Qn (n is an integer, and satisfies $1 \leqq n \leqq M$) from a corresponding stage of the shift register 101. All stages of the latch B-circuit 103 latch, in block, the signals QA1 through QAM in response to the latch clock input signal LCL. The decoder 104 decodes the 4-bit signal DI1 through DI4 for each stage.

One of the data DO0 through DO15 is selected in accordance with each result of the decoded 4-bit signal DI1 through DI4. This allows one of 16 analog switches in the analog switch group 106 to be selected via the level shifter 105.

This selection allows a target one of 16 gradation levels of the liquid crystal driving voltage that is externally supplied to be outputted to a source line as a final analog driver output O. Note that the symbol "i" indicates the data of i-row.

Pursuant to the demand that a large-sized screen be produced, conventional liquid crystal display apparatuses, having the above configuration, have been developed so as to be exploited in screens for TVs or PCs. Meanwhile, small and medium liquid crystal panel and liquid crystal driving circuit (liquid crystal driving apparatuses) suitable for a portable terminal such as a mobile phone have recently been developed such that the liquid crystal display apparatus is exploited in the portable terminal that has gained market share rapidly. With regard to the liquid crystal panel and liquid crystal driving circuit, strongly desired are downsizing, weight saving, low power consumption including battery-driving, multiple-output, speeding up, improvement in display quality, and low cost.

It is the tendency for the amount of data signal outputted at a same timing in block from a latch circuit to increase. The data signal is outputted from the latch circuit in sync with rising or falling edge of a latch signal LS. In the case of the configuration shown in FIG. 13, the data signal is outputted in sync with a falling edge of the latch clock input signal LCL. This tendency is derived from the affect by the large-sized liquid crystal panel and the multiple-output of the liquid crystal driving circuit.

On this occasion, as shown in FIG. 17, the power source current, which is supplied to the liquid crystal driving circuit, has a great peak value, thereby resulting in that the electric current consumption becomes great. FIG. 17 shows the measurement results of peak values of the power source current flowing in GND line (logical GND) in a logical circuit and a level shifter (a level shifter circuit), respectively.

Thus, according to the conventional technique, the current intensively flows in the logical GND, thereby giving rise to the occurrence of a great noise. This causes the problem that the data in a hold circuit section is changed.

In view of the circumstance, a liquid crystal display apparatus, which can reduce a peak value of the power source current in a driving circuit, has been developed. This kind of liquid crystal display apparatus is disclosed in Japanese unexamined patent publication No. 8-22267 published on Jan. 23, 1996, for example. FIG. 15 shows the configuration of such a conventional liquid crystal display apparatus.

A liquid crystal panel control apparatus 205 shown in FIG. 15 controls a liquid crystal panel 201. The liquid crystal panel control apparatus 205 receives a display data from a CPU 204, and generates clock pulses CL1 and CL2, a display data Din, and a frame signal FLM, respectively, which are required for the operation of the liquid crystal panel 201.

An alternating signal generation circuit 206 counts the clock pulse CL1 that corresponds to selection timing, and changes the polarity of an alternating signal M for every plurality of scanning lines during one frame (a display period during which one screen is displayed). This allows a frequency for the alternation to become high up to around hundreds of Hz, so as to avoid the flickering of the screen due to the alternation. Note that the flickering of the screen due to the alternation comes to an issue that the screen flickers, if the polarity of the alternating signal is changed for each frame, for example. This is because the frequency of the polarity inversion becomes relatively low.

A voltage generation circuit 207 generates driving voltages V1 through V6 that are supplied to a scanning driver 203 and a data driver 202. The voltage generation circuit 207 includes resistors that are connected in a series manner and operational amplifiers The liquid crystal panel 201 includes m×n pixels. Namely, the liquid crystal display apparatus includes m scanning lines X1 through Xm and n signal lines Y1 through Yn.

The scanning driver 203 includes a shift register that carries out a shift operation in accordance with the clock pulse CL1. The scanning driver 203 allows a scanning line electrode to output the driving voltage generated by the voltage generation circuit 207 in accordance with an output signal of the shift register. The scanning driver 203 allows a corresponding scanning line electrode to have a selection level or a non-selection level.

More specifically, when the output signal of the shift register has a selection level, the scanning driver 203 outputs the driving voltage V1 to a corresponding scanning line electrode. Meanwhile, other scanning line driving voltages are the driving voltage V5 that corresponds to the non-selection level of the output signal of the shift register. The shift register sequentially shifts the selection level in sync with the clock pulse CL1. Because of this, a neighboring scanning line electrode has the selection level at the next timing. Thus, the scanning line electrodes are sequentially selected.

The scanning driver 203 switches the driving voltages V1 and V5 to the driving voltages V2 and V6, respectively, in accordance with the alternating signal M. More specifically, when the polarity of the alternating signal M is changed for every plurality of scanning lines during one frame, (i) the selection level is switched from the driving voltage V1 to V2 and vise versa, and (ii) the non-selection level is switched from the driving voltage V5 to V6 and vice versa.

The pixel data Din is serially supplied to a serial/parallel conversion circuit SPC in sync with the clock pulse CL2. A pixel signal corresponding to one scanning line is supplied to a signal line electrode in sync with a clock pulse CL2 during 1H period (within one cycle of the clock pulse CL1).

The pixel signal corresponding to one scanning line thus serially supplied is sent in parallel to a line data latch circuit C shown in FIG. 16. FIG. 16 shows how a driving circuit (the data driver 202), for use in a liquid crystal display apparatus shown in FIG. 15, is configured.

In the data driver 202, the image data is supplied to a level shifter circuit B from a line data latch circuit C that carries out the above described serial to parallel conversion. This allows the image data to be subject to a level shift processing. The line data latch circuit C is configured by a circuit to which a 5-volt power source is supplied. The line data latch circuit C outputs a signal having a high level of 5-volt or a signal having a low level of 0-volt.

In contrast, a driver A, for generating a display output signal that is supplied to a signal line, is configured by a switch MOSFET. The level shifter circuit B allows the output signal of the line data latch circuit C to be subject to the level shift processing. This is made for the purpose of outputting, without any level loss, a voltage, which falls within a relatively great range, such as the driving voltage V1, V3, V4, or V2 generated by the voltage generation circuit 207.

In the liquid crystal display apparatus, as shown in FIG. 16, a delay circuit D is provided between neighboring circuit groups CG. Accordingly, the display output signals outputted from the neighboring circuit groups CG have a phase lag, corresponding to the delay time of the delay circuit D, one another.

This allows the display output signals (display driving currents) to be dispersed and outputted for each circuit group CG. Because of this, the peak current is dispersed and flowed in the power source line, even if the number of the signal lines increases due to the large-sized screen or the high definition. Thus, it is possible to drastically reduce the peak current (the peak value of the power source current) flowing in the power source line (the logical GND line).

As described above, the liquid crystal panel includes many signal line electrodes (n signal line electrodes). The large-sized screen or the high definition causes the number n of the signal line electrodes to astronomically increase. Because of this, the liquid crystal panel includes a plurality of driving circuits having the configuration shown in FIG. 16. This gives rise to the configuration in which a plurality of semiconductor integration circuit apparatuses for driving the signal lines is mounted on a substrate (a mounting substrate).

Even in this case, it is possible in a driving circuit shown in FIG. 16 to disperse the driving current flowing in the power source line in each of the semiconductor integration circuit apparatuses, because the timing for the data latch signal has a phase lag one after another. Accordingly, it is also possible to reduce the peak value of the driving current even in the power source line on the mounting substrate.

Thus, according to the conventional driving circuit, the latch signal LS is delayed so as to reduce the peak value of the power source current.

However, this causes a setup time, provided between the latch signal LS and the start pulse signal in the next horizontal period, to be reduced as shown in FIG. 18.

This gives rise to the problem that the driving circuit erroneously operates for the reason that the latch signal LS cannot be appropriately recognized during one horizontal period.

This driving circuit is configured such that the latch signal LS simply has a phase lag by being sequentially subject to the delay circuits. Although the peak value of the power source current which is supplied to the data driver 202 (signal line driving circuit) can be reduced, the output signals of the data driver 202 also have a phase lag. In other words, the data driver 202 is not configured so as to output the analog signals at a time in block.

This results in that the charging time of the output signals is not uniform in the liquid crystal display apparatus, thereby causing nonuniform display to occur.

SUMMARY OF THE INVENTION

The present invention is made in view of the foregoing conventional problems, and its object is to provide (i) a driving apparatus that enables to reduce the peak value of the power source current and enables to avoid that the output timing is not uniform, and (ii) a display module including such a driving apparatus.

In order to achieve the above object, a driving apparatus in accordance with the present invention (a present driving apparatus) is designed so as to include: (i) a memory circuit including latch cells, each latching and outputting display data, corresponding to one horizontal synchronization period, in accordance with an inputted horizontal synchronization signal; (ii) a conversion circuit that generates a plurality of driving signals in accordance with the display data outputted from the latch cells, the driving signals being for driving a display section; and (iii) a switch circuit that receives the driving signals generated by the conversion circuit and outputs the driving signals to the display section, wherein the memory circuit includes: (a) a delay circuit that delays an outputting of the horizontal synchronization signal to some of the latch cells; and (b) a control circuit that outputs a display start signal to the switch circuit after the entire latch cells output the display data, respectively, the switch circuit simultaneously outputting to the display section, in response to the display start signal, the driving signals received from the conversion circuit.

The present driving apparatus functions as a so-called source driver that outputs the driving signals to a display section such as a liquid crystal panel in response to a horizontal synchronization signal.

Here, the driving signals indicate signals to be supplied to source lines (source signal lines) of the display section. The number of the driving signals is determined by the number of the source lines in the display section and/or the number of colors of the signal.

More specifically, in the present invention, the latch cells in the memory circuit latch the display data, corresponding to one horizontal synchronization period, in accordance with the horizontal synchronization signal. The conversion circuit converts the display data thus latched into the driving signals, and outputs them to the display section via the switch circuit.

Note that the conversion circuit indicates a circuit that generates the driving signals. The conversion circuit is, for example, a level shifter circuit that carries out a level conversion of the level of the display data, or a D/A conversion circuit that selects an analog voltage in accordance with the display data that has been subject to the level conversion.

In especial, in the present invention, the memory circuit includes a delay circuit that delays an outputting of the horizontal synchronization signal to some of the latch cells.

Accordingly, it is possible that the timing, at which the latch cell latches the display data, is not a specified one. Because of this, the timing (the timing of generating the driving signals) of outputting the display data to the conversion circuit differs from latch cell to latch cell.

This gives rise to the similar nonuniformity of the timing of supplying the power source current for driving the latch cell and the conversion circuit. This ensures to avoid that the excessive peak current flows in the line via which the power source current flows. The excessive peak current indicates such a current that drives the entire latch cells and the conversion circuit. Accordingly, it is possible to avoid that the noise occurs due to the peak current.

Further, in the present driving apparatus, the memory circuit includes a control circuit that outputs a display start signal (an output timing signal) to the switch circuit.

In especial, in the present driving apparatus, the control circuit is designed so as to output a display start signal after the entire latch cells output the display data to the conversion circuit. Namely, when outputting of a display start signal, the entire latch cells have already outputted the display data and the conversion circuit has generated the entire driving signals.

At this stage, upon receipt of the display start signal, the switch circuit of the present driving apparatus is designed so as to output, all at once, the entire driving signals to the entire source lines of the display section.

According to the present driving apparatus, there occurs no nonuniform output timing in the driving signal. In other words, the driving signals can be simultaneously outputted to the entire source lines of the display section. This allows the display section to be charged by the driving signals within a single specified period of time. Thus, it is possible to avoid that there occurs a nonuniform displaying in the display section.

For a fuller understanding of the nature and advantages of the invention, reference should be made to the ensuing detailed description taken in conjunction with the accompanying drawings.

DESCRIPTION OF THE EMBODIMENTS

The following description deals with one embodiment of the present invention.

Figure 2:
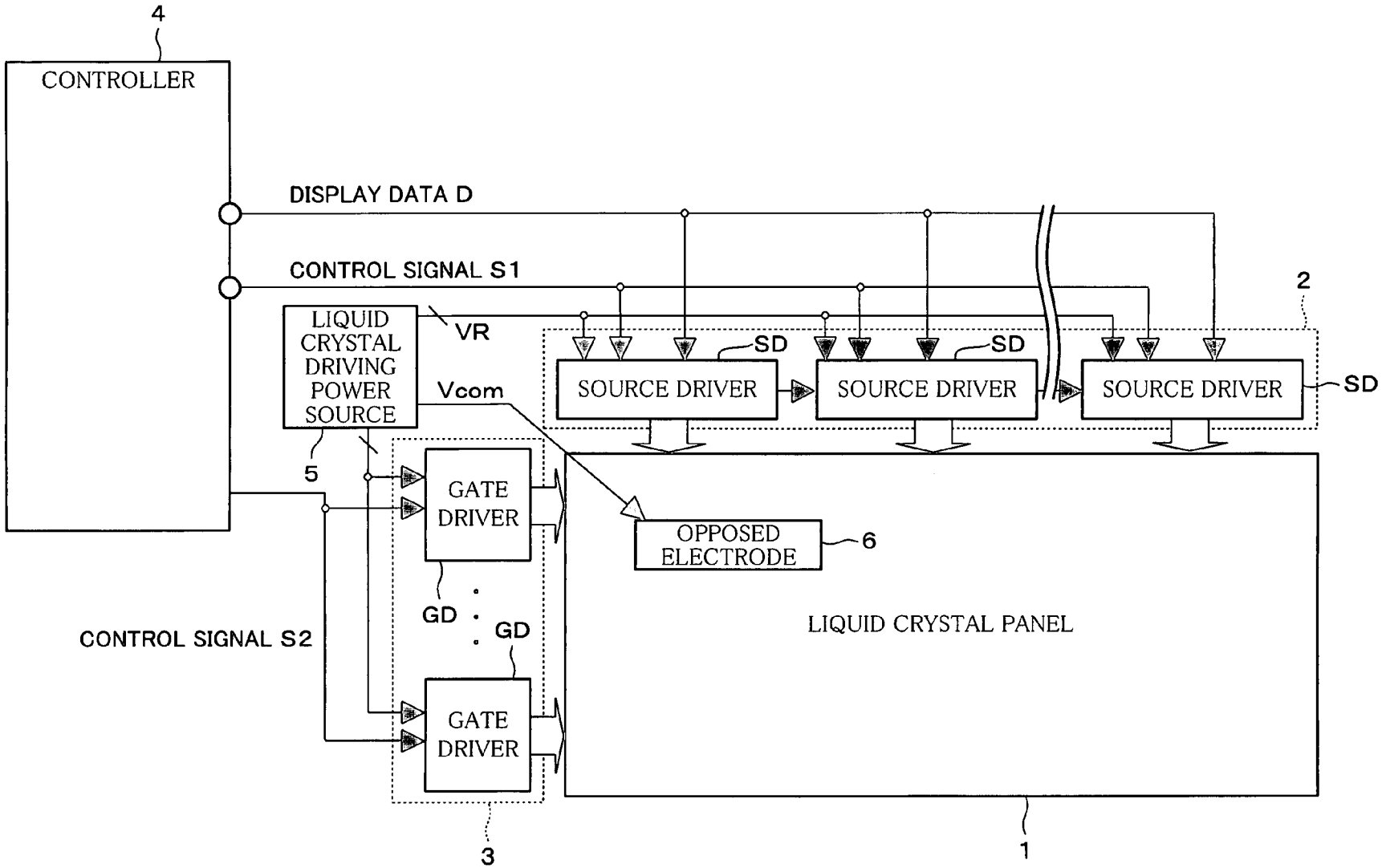
FIG. 2 is an explanatory diagram showing a main part of a liquid crystal display apparatus including the driving apparatus shown in FIG. 1.

FIG. 2 is a block diagram showing a main part of a liquid crystal display apparatus (the present liquid crystal display apparatus; a display module) in accordance with the present embodiment. As shown in FIG. 2, the present liquid crystal display apparatus includes a liquid crystal panel 1, a driver IC 2, a driver IC 3, a controller 4, and a liquid crystal driving power source 5.

The present liquid crystal display apparatus is a liquid crystal display apparatus of an active matrix type, and has a configuration in which the liquid crystal panel 1 includes liquid crystal display devices including TFTs (thin film transistors) provided in a matrix manner. Each of the liquid crystal display devices in the liquid crystal panel 1 includes an opposed electrode (a common electrode) 6.

The driver IC 2, the driver IC 3, the controller 4, and the liquid crystal driving power source 5 respectively control the driving of the liquid crystal panel 1.

According to the present liquid crystal display apparatus, the drivers IC 2 and IC 3 selectively supply, in response to the controller 4, to the liquid crystal panel 1 voltages outputted from the liquid crystal driving power source 5. This allows the liquid crystal panel 1 to carry out the displaying.

The driver IC 2 includes n (n: natural number) source drivers SD. The driver IC 3 includes m (m: natural number) gate drivers GD.

Each of the source drivers SD is made of an IC (integrated circuit). Each of the source drivers SD and the gate drivers GD is made of an IC (integrated circuit). The source driver SD (driving apparatus) drives a source signal line 14 (see FIG. 3) in the liquid crystal panel 1. The gate driver GD drives a gate signal line 15 (see FIG. 3) in the liquid crystal panel 1.

The controller 4 outputs to the driver IC 2 an externally supplied display data as a digital display data D.

The controller 4 also outputs to the driver IC 2 a control signal S1 for controlling the source drivers SD. The control signal S1 includes a horizontal synchronization signal (a latch signal) LS, a start pulse SP, and a clock signal for source driver use (hereinafter, referred to as a clock signal), which are later described. The display data D includes RGB signals (display data DR, display data DG, and display data DB) respectively corresponding to red, green, and blue colors.

The horizontal synchronization signal LS, the clock signal CK, and the display data D are supplied to the respective source drivers SD. The start pulse SP is supplied only to one of the source drivers SD. For example, in the present embodiment, the start pulse SP is supplied to the nearest source driver SD to the controller 4.

The controller 4 further outputs to the driver IC 3 a control signal S2 including a vertical synchronization signal and a clock signal for gate driver use.

Each of the source drivers SD in the driver IC 2 receives the digital display data D via the controller 4, and latches the digital display data D in a time-sharing manner. Then, the source driver SD carries out a digital to analog conversion with respect to the display data D in sync with the horizontal synchronization signal LS (the latch signal, see FIG. 1) outputted from the controller 4. This allows the source driver SD to obtain an analog voltage for gradation display use (a gradation display voltage).

The source driver SD outputs the analog voltage thus obtained via output terminals (later described output terminals X1 through Z100; see FIG. 1) for the respective gradation display voltages (liquid crystal driving voltages). The analog voltages thus outputted are supplied, via source lines 14 (later described; see FIG. 3), to the liquid crystal display devices in the liquid crystal panel 1 respectively corresponding to the output terminals X1 through Z100.

The configuration of the source driver SD will be later described.

The liquid crystal driving power source 5 supplies the drivers IC 2 and IC 3 with voltages causing the liquid crystal panel 1 to carrying out the displaying. The liquid crystal driving power source 5 supplies the driver IC 2 with a reference voltage (later described) for generating the gradation display voltage, for example.

Note that FIG. 2 omits power sources that supply to the drivers IC 2 and IC 3 driving voltages for the source drivers SD and the gate drivers GD, respectively.

Figure 3:
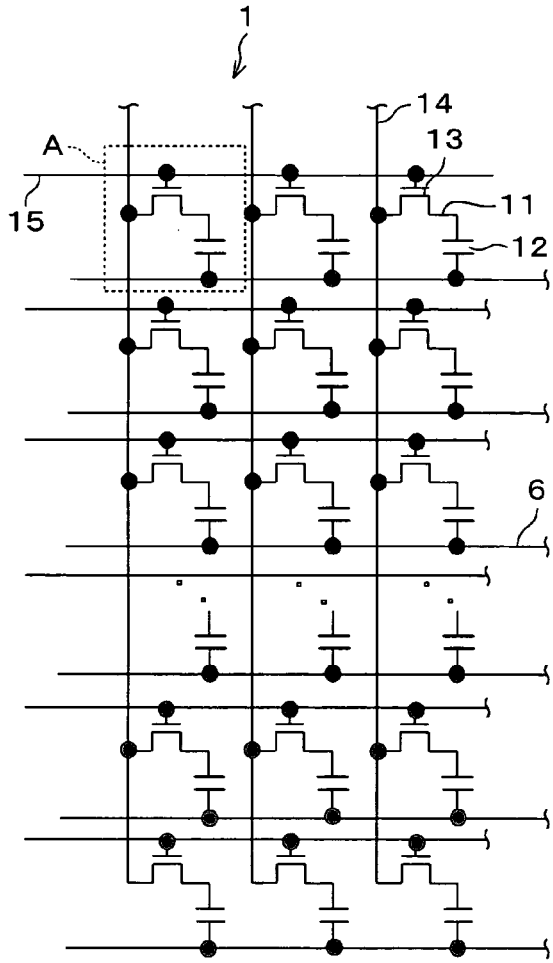
FIG. 3 is an explanatory diagram showing a configuration of a liquid crystal panel.

The following description deals with the configuration of the liquid crystal panel 1 with reference to FIG. 3.

The liquid crystal panel 1 includes pixel electrodes 11, pixel capacities 12, TFTs 13 (switching device) for supplying or not supplying the voltages to the respective pixel electrodes 11, source signal lines 14, gate signal lines 15, and opposed electrodes 6. Note that a region indicated as "A" in FIG. 3 represents a liquid crystal display device corresponding to one pixel. A pixel electrode 11, a pixel capacity 12, a TFT 13, a source signal line 14, a gate signal line 15, and an opposed electrode 6 define the region "A". A liquid crystal is held tight by the pixel electrode 11 and the opposed electrode 6.

The foregoing source driver SD supplies to the source signal line 14 a gradation display voltage that varies depending on the brightness of a pixel to be displayed. The gradation display voltage is a signal (a driving signal) outputted from the source driver SD.

The gate driver GD supplies to the gate signal line 15 a scanning signal such that the TFTs 13 disposed in a longitudinal direction sequentially turn on.

When an voltage of the source signal line 14 is supplied to the pixel electrode 11 that is connected to a drain terminal of the TFT 13, the pixel capacity 12 between the pixel electrode 11 and the opposed electrode 6 is charged. This allows the voltage, which is supplied to the liquid crystal, to change, thereby changing the light transmittance of the liquid crystal. On this account, the liquid crystal panel 1 carries out the displaying.

Figure 4:
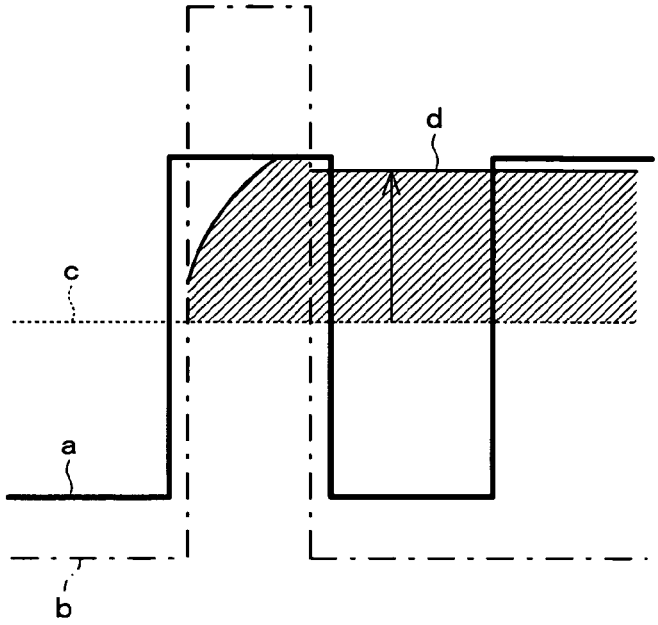
FIG. 4 is an explanatory diagram showing one example of liquid crystal driving waveforms including a driving waveform of a signal outputted from a source driver, a driving waveform of a signal outputted from a gate driver, a voltage waveform of an opposed electrode, a voltage waveform of a pixel electrode, and a waveform of a voltage to be applied to a liquid crystal.
Figure 5:
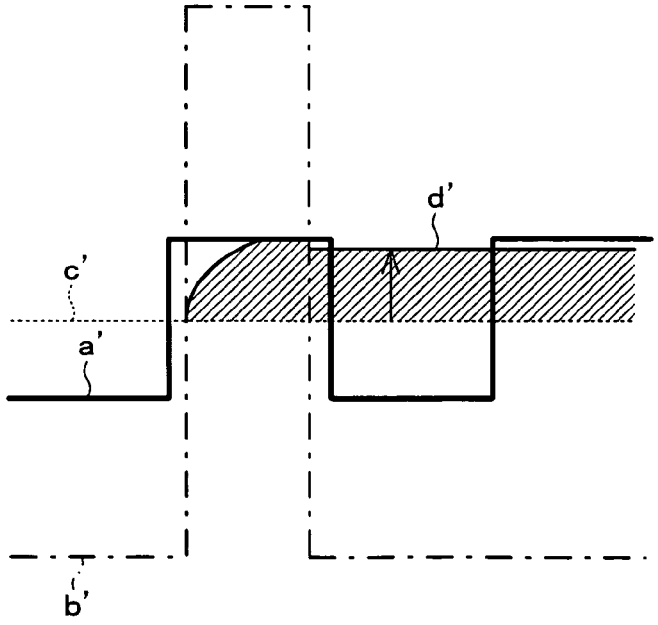
FIG. 5 is an explanatory diagram showing another example of liquid crystal driving waveforms including a driving waveform of a signal outputted from a source driver, a driving waveform of a signal outputted from a gate driver, a voltage waveform of an opposed electrode, a voltage waveform of a pixel electrode, and a waveform of a voltage to be applied to a liquid crystal.

The following description deals with a voltage (a liquid crystal voltage) to be supplied to the liquid crystal with reference to FIG. 4 and FIG. 5 each showing one example of liquid crystal driving waveforms.

In FIG. 4 and FIG. 5, symbols indicated as "a" and "a'" are the driving waveforms of the signals outputted from the source driver SD, respectively. Symbols indicated as "b" and "b'" are the driving waveforms of the signals outputted from the gate driver GD, respectively. Symbols indicated as "c" and "c'" are the waveforms of the voltages of the opposed electrode 6, respectively.

In FIG. 4 and FIG. 5, symbols indicated as "d" and "d'" are the waveforms of the voltages of the pixel electrode 11, respectively. The liquid crystal voltage is equal to an electric potential difference (see slanting lines in FIG. 4 and FIG. 5) between the pixel electrode 11 and the opposed electrode 6.

For example, in the case of FIG. 4, when a driving waveform "b" (an output signal of the gate driver GD) has a High level, the TFT 13 turns on. This allows the pixel electrode 11 to receive a difference (a liquid crystal voltage) between a driving waveform "a" (an output signal of the source driver SD) and a waveform "c" (an electric potential of the opposed electrode 6).

Thereafter, when the driving waveform "b" changes to a LOW level, the TFT 13 turns off. At this time, in the pixel, the voltage of the pixel electrode 11 is maintained by the pixel capacity 12. On this account, the liquid crystal voltage (see slanting lines in FIG. 4) is maintained. In like manner, the liquid crystal voltage is maintained in FIG. 5.

Note that the liquid crystal voltage of FIG. 5 is smaller than that of FIG. 4.

Thus, it is possible to realize the gradation display by changing the liquid crystal voltage in an analog manner so as to change the light transmittance of the liquid crystal in an analog manner. The number of possible display gradations is determined by the number of the selections of the liquid crystal voltages.

Figure 1:
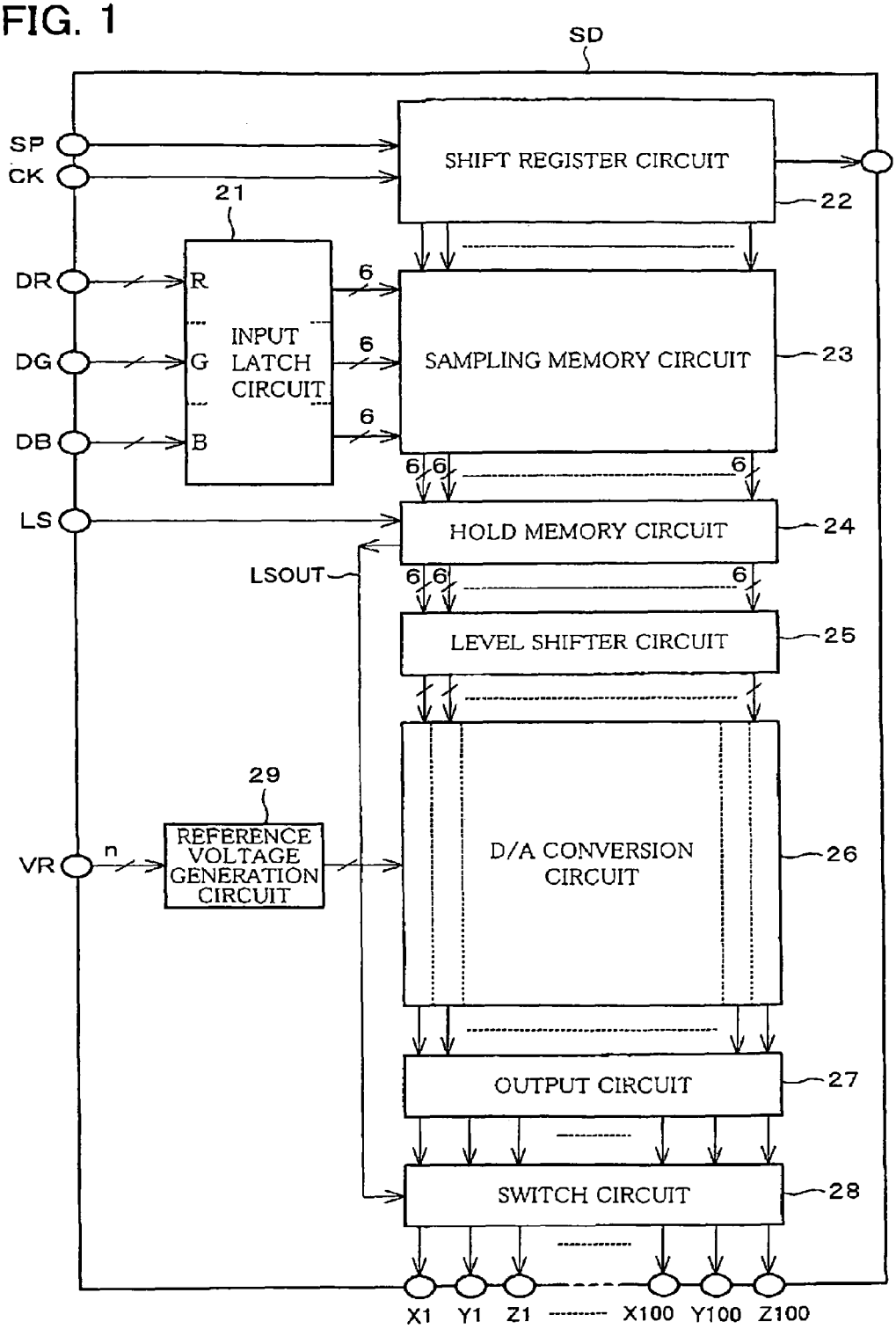
FIG. 1 is a block diagram showing a configuration of a main part of a driving apparatus of one embodiment in accordance with the present invention.

The following description deals with a detailed configuration of the source driver SD with reference to FIG. 1.

Each of the source drivers SD drives the pixels (liquid crystal display devices) of 100×3 (RGB) so as to carry out the displaying of $2^6$=64 gradations. More specifically, the display data D (see FIG. 2) outputted from the controller 4 includes three display data (DR corresponding to red color, DG corresponding to green color, and DB corresponding to blue color) each being 6-bit display data.

As shown in FIG. 1, the source driver SD includes an input latch circuit 21, a shift register circuit 22, a sampling memory circuit 23, a hold memory circuit 24 (a hold memory circuit section, a memory circuit), a level shifter circuit 25 (a conversion section, a conversion circuit), a D/A conversion circuit 26 (a conversion section, a conversion circuit), an output circuit 27 (a conversion section, a conversion circuit), a switch circuit 28 (a switch circuit section), and a reference voltage generation circuit 29.

The shift register circuit 22 shifts an inputted start pulse SP in sync with an inputted clock signal CK. Each stage of the shift register circuit 22 outputs a control signal to the sampling memory circuit 23.

Note that the start pulse SP is in sync with a horizontal synchronization signal LS of the data signal D. The start pulse SP that has been shifted by the shift register circuit 22 is supplied, as a start pulse SP, to a shift register circuit of a next source driver SD so as to be shifted in like manner. In the end, the start pulse SP is transferred to a shift register circuit of a farthest source driver SD from the controller 4.

The input latch circuit 21 includes input terminals corresponding to respective colors. The input latch circuit 21 temporarily latches the display data DR, DG, and DB (each having 6-bit) that are serially supplied via the respective input terminals, and supplies the display data thus latched to the sampling memory circuit 23.

The sampling memory circuit 23 carries out the samplings (the samplings in a time-sharing manner) with respect to the display data DR, DG, and DB (6-bit for each of R, G, and, B; totally 18-bit display data) in accordance with the output signals (control signals) from the respective stages of the shift register circuit 22.

The sampling memory circuit 23 temporarily stores the display data DR, DG, and DB, respectively, until entirely obtaining the display data (DR, DG, and DB) corresponding to one horizontal synchronization period.

When entirely obtaining the display data (DR, DG, and DB), corresponding to one horizontal synchronization period, in the sampling memory circuit 23, a horizontal synchronization signal LS and the display data DR, DG, and DB are respectively supplied to the hold memory circuit 24.

The hold memory circuit 24 (i) latches the display data DR, DG, and DB thus supplied in accordance with the horizontal synchronization signal LS, (ii) holds (maintains) them until the next horizontal synchronization signal LS is supplied, and (iii) outputs them to the level shift circuit 25. The configuration of the hold memory circuit 24 will be later described in detail.

In the level shift circuit 25, each signal level of the display data DR, DG, and DB is converted by boosting or other processing such that the level of a voltage to be supplied to the liquid crystal panel 1 is compatible with the D/A conversion circuit 26 of the next stage.

More specifically, in the level shift circuit 25, carried out is the level conversion of the display data DR, DG, and DB into the level of a maximum driving voltage to be supplied to the liquid crystal panel 1, so as to generate digital display data D'R, D'G, and D'B (each 6-bit). Then, the level shift circuit 25 outputs the digital display data D'R, D'G, and D'B to the D/A conversion circuit 26.

The reference voltage generation circuit 29 generates 64-level analog voltages, used for the gradation display, in accordance with the reference voltage VR outputted from the liquid crystal driving power source 5 (see FIG. 2), and supplies the 64-level analog voltages to the D/A conversion circuit 26. The 64-level analog voltages are the gradation display voltages that are supplied to the source signal lines 14 in the liquid crystal panel 1. The gradation display voltages are 64-level voltages when carrying out the 64-gradation display.

The D/A conversion circuit 26 converts the display data D'R, D'G, and D'B outputted from the level shift circuit 25 into an analog voltage. More specifically, the D/A conversion circuit 26 selects one of 64-level voltages in accordance with the display data D'R, D'G, and D'B, and outputs it to the output circuit 27.

Figure 11:
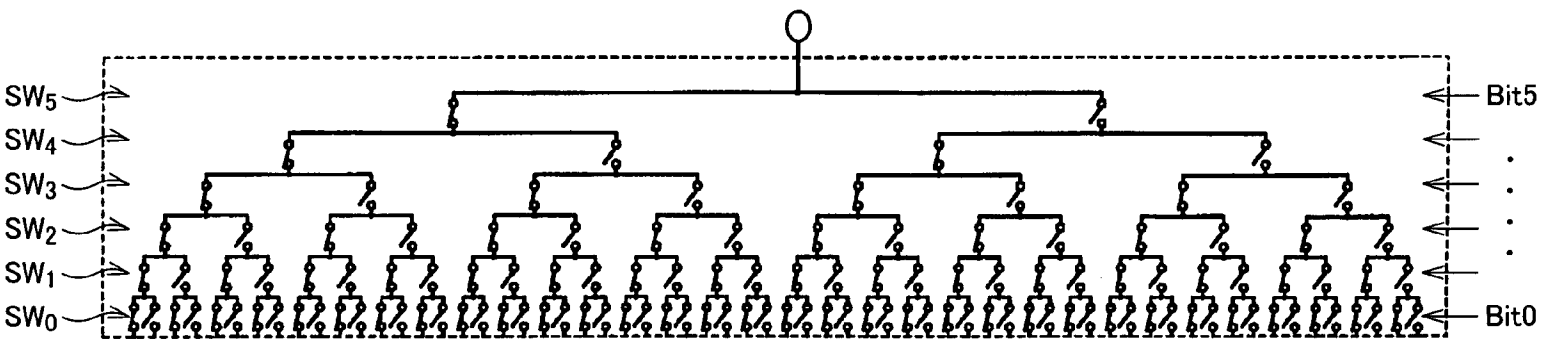
FIG. 11 is an explanatory diagram showing a configuration of D/A conversion circuit.

Namely, the D/A conversion circuit 26 includes switches ($SW_0$ through $SW_5$) corresponding to respective 6 bits (Bit 0 through Bit 5), as shown in FIG. 11.

The D/A conversion circuit 26 selects the switches $SW_0$ through $SW_5$ in accordance with the 6-bit display data D'R, D'G, and D'B. This allows the D/A conversion circuit 26 to select one of the 64-level voltages supplied from the reference voltage generation circuit 29.

The output circuit 27 amplifies the analog signal selected by the D/A conversion circuit 26, and converts it into a low-impedance signal, so as to generate the gradation display voltage. The gradation display voltage thus generated is supplied to the switch circuit 28.

The output circuit 27 is a buffer circuit, and is realized by a voltage follower circuit in which a differential amplifier is used, for example.

The switch circuit 28 includes analog switches for controlling the outputting of the gradation display voltage. The analog switches are switched on (in a conductive state) and/or off (not in a conductive state) in accordance with a display start signal LSOUT (later described) supplied from the hold memory circuit 24.

During the switching on, the switch circuit 28 outputs at a time in block the analog signals (gradation display voltages (driving signals)) to the source signal lines 14 (see FIG. 3) of the liquid crystal panel 1, via output terminals X1 through X100, Y1 through Y100, and Z1 through Z100, respectively.

Thus, each of the source drivers SD for the 64-gradation display outputs to the liquid crystal panel 1 the analog signal corresponding to the gradation level in accordance with the display data DR, DG, and DB, so as to carry out the 64-gradation display.

Note that the output terminals X1 through X100, Y1 through Y100, and Z1 through Z100 for the gradation display voltage correspond to the display data DR, DG, and DB, respectively. The X, Y, and Z have 100 output terminals, respectively.

The operation of the switch circuit 28 will be later described.

Figure 9:
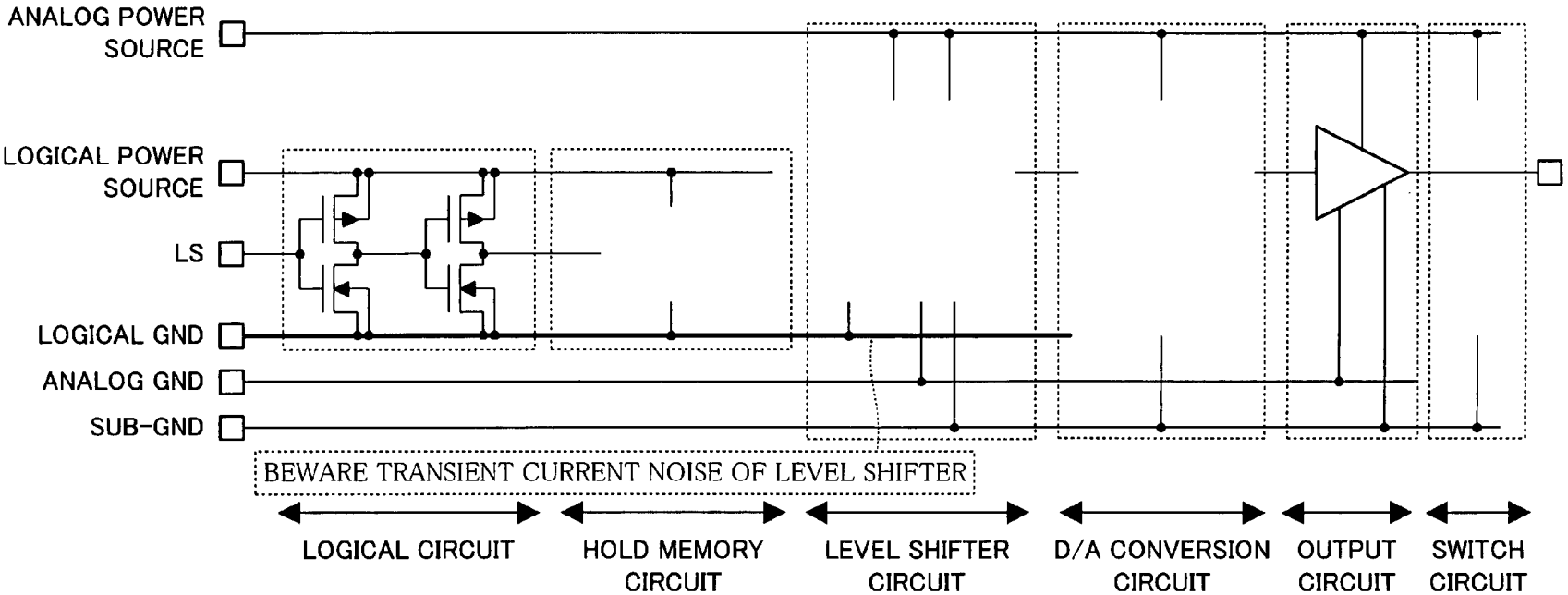
FIG. 9 is an explanatory diagram showing power sources to be supplied to a main block configuration of a source driver.

The following description deals with the power sources that are supplied to the main block configuration of the source driver SD with reference to FIG. 9.

In FIG. 9, the logical circuit indicates a logical circuit part that is drivable with a low-voltage supply, and includes the input latch circuit 21, the shift register 22, and the sampling memory circuit 23, respectively.

As shown in FIG. 9, a logical power source and a logical GND are connected to the logical circuit and the hold memory circuit 24.

An analog power source is a high-voltage power source for driving the liquid crystal panel 1. The analog power source, an analog GND, and a SUB-GND are connected to the level shifter circuit 25 (high-voltage side), the D/A conversion circuit 26, the output circuit 27, and the switch circuit 28. The SUB-GND is provided for placing the power sources in a more stabilized condition.

The following description deals with the hold memory circuit 24.

Figure 6:
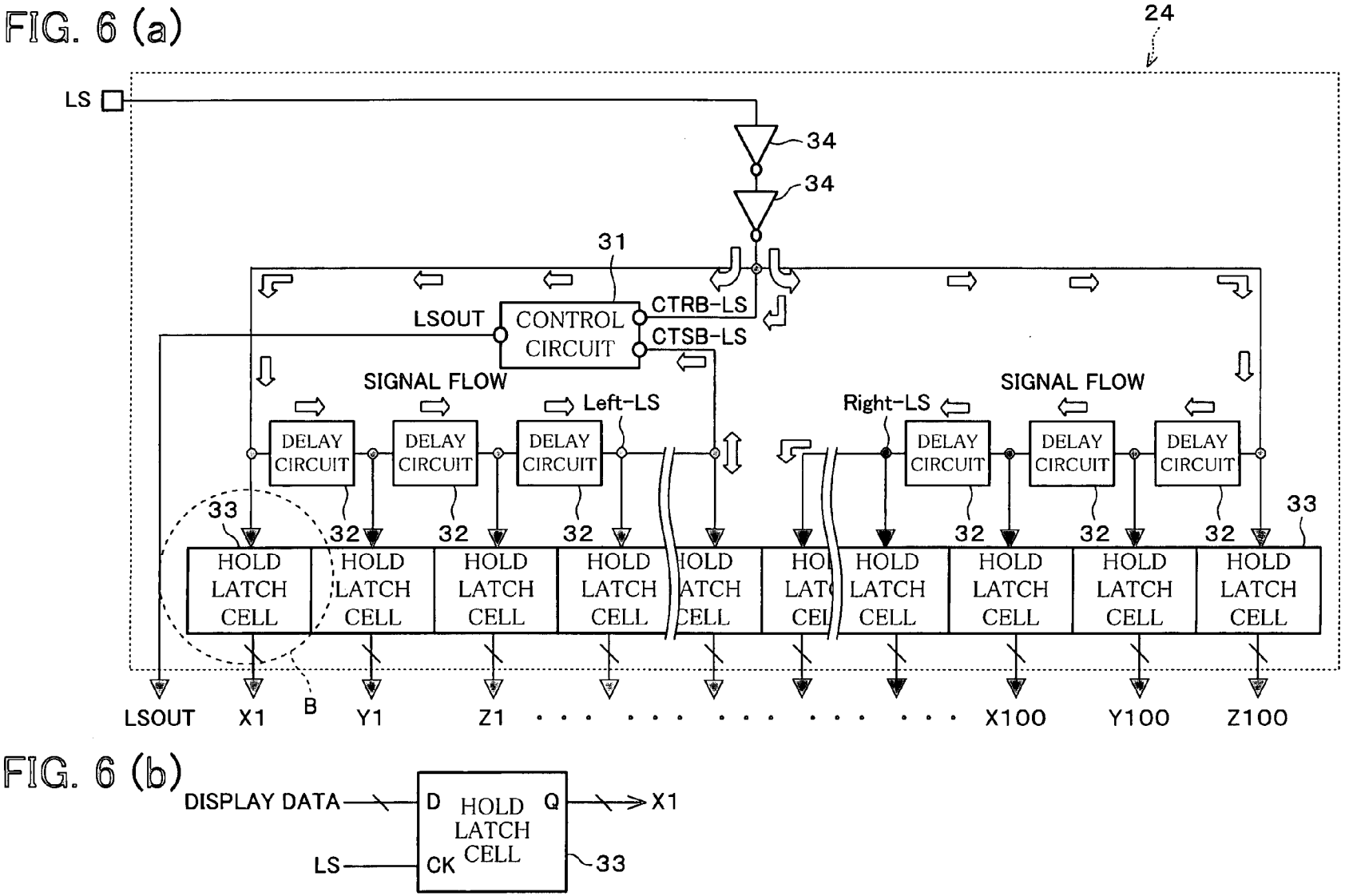
FIG. 6(*a*) is a block diagram showing a configuration of a hold memory circuit, and FIG. 6(*b*) is an explanatory diagram showing a configuration of a hold latch cell in the hold memory circuit.

As shown in FIG. 6(*a*), the hold memory circuit 24 includes a control circuit 31 (control means), delay circuits 32 (delay means), hold latch cells 33 (hold latch means, latch cell), and inverter circuits 34.

For each of the output circuits 27, the hold memory circuit 24 includes a plurality of hold latch cells 33 whose number corresponds to the number of the output terminals. Namely, the hold memory circuit 24 includes 6 hold latch cells 33 for the 6-bit display data.

FIG. 6(*b*) shows the hold latch cells 33 in a region indicated as "B" of FIG. 6(*a*). As shown in FIG. 6(*b*), each of the hold latch cells 33 is designed so as to receive a corresponding display data D and a horizontal synchronization signal LS, respectively. Each of the hold latch cells 33 is designed so as to output the display data D to corresponding output terminals in sync with the inputting timing of horizontal synchronization signal LS.

In the hold memory circuit 24, the hold latch cells 33 are divided into two groups, i.e., left and right groups. The left group corresponds to the first group including output terminals X1 through Z50, and the right group corresponds to the second group including output terminals Z100 through X51.

The latching operations of the hold latch cells 33 are collaterally carried out for the respective groups. The latching operations correspond to the inputting operations of the horizontal synchronization signal LS with respect to the hold latch cells 33.

Further, in the hold memory circuit 24, the horizontal synchronization signal LS is sequentially supplied to each of the hold latch cells 33 in such a direction as to be headed from both ends to the center.

More specifically, the horizontal synchronization signal LS is sequentially supplied to the hold latch cells 33 in the first group corresponding to the output terminals X1 through Z50, in a such direction as to be headed from the left side to the center. In contrast, the horizontal synchronization signal LS is sequentially supplied to the hold latch cells 33 in the second group corresponding to the output terminals Z100 through X51, in such a direction as to be headed from the right side to the center.

Note that three delay circuits 32 are provided for each of the first and second groups so as to correspond to the first through third hold latch cells 33 from the end.

The horizontal synchronization signal LS is supplied to the hold latch cells 33 (corresponding to the respective output terminals X1 and Z100) at both ends, via a multiple-stage inverter (here, a two-stage inverter including two inverters 34 that are serially connected to one another).

For each of the first and second groups, a horizontal synchronization signal LS, which has been delayed by the first delay circuit 32 from the end, is supplied to a neighboring hold latch cell 33 (the second hold latch cell 33 from the end). The neighboring hold latch cell 33 corresponds to the output terminal Y1 for the first group, whereas the output terminal Y100 for the second group.

Further, a horizontal synchronization signal LS, which has been delayed by the first and second delay circuits 32 from the end, is supplied to the third hold latch cell 33 from the end. The third hold latch cell 33 corresponds to the output terminal Z1 for the first group, whereas the output terminal X100 for the second group. In like manner, a horizontal synchronization signal LS, which has been delayed by the first through third delay circuits 32 from the end, is supplied to the fourth and its subsequent hold latch cells 33 from the end. The fourth and its subsequent hold latch cells 33 correspond to the output terminals X2 through Z99.

Thus, in hold memory circuit 24, the serially inputted horizontal synchronization signal LS is supplied to each of the hold latch cells 33 with delay due to each of the delay circuits 32.

The display data DR, DG, and DB from the sampling memory circuit 23 are fetched in by the respective hold latch cells 33 in sync with the inputting timing of the horizontal synchronization signal LS, and are supplied to the level shifter circuit 25.

This causes the level shifter circuit 25 to operate with the above delay due to the delay circuit 32, accordingly.

Figure 10:
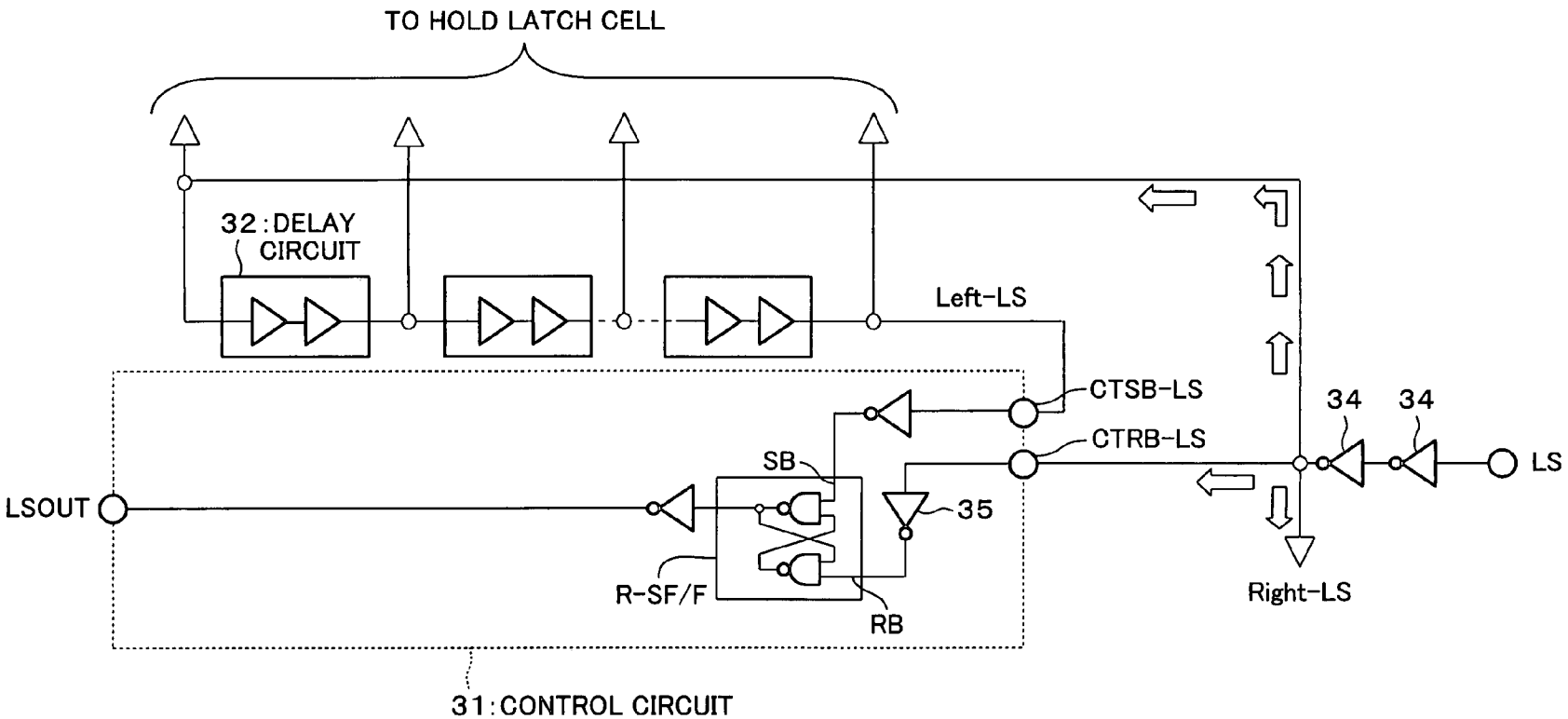
FIG. 10 is an explanatory diagram showing a configuration of a control circuit in a hold memory circuit.

The following description deals with the configuration of the control circuit 31 in the hold memory circuit 24 with reference to FIG. 10 and FIG. 6(*a*).

In the control circuit 31, the display start signal LSOUT is generated in accordance with (i) a horizontal synchronization signal LS supplied via the inverter circuits 34 and (ii) a horizontal synchronization signal LS supplied via the delay circuit 32 (later described), and is outputted to the switch circuit 28.

Namely, it is designed such that the analog switches in the switch circuit 28 are switched on (in a connecting state) and/or off (not in a connecting state) in response to the display start signal LSOUT outputted from the control circuit 31.

As shown in FIG. 10 or FIG. 6(*a*), the horizontal synchronization signal (the latch signal) LS that has been supplied to the hold memory circuit 24 is supplied to a first input terminal CTRB-LS of the control circuit 31 via the two inverter circuits 34.

The first input terminal CTRB-LS is connected to one input terminal RB of an R-S flip-flop (R-SF/F) of NAND-type via an inverter circuit 35 (one stage of inverter circuit).

A second input terminal CTSB-LS is connected to the first input terminal CTRB-LS via the foregoing delay circuits 32 that are serially connected to each other. The second input terminal CTSB-LS is connected to the other input terminal SB of the R-S flip-flop via an inverter circuit 36 (one stage of inverter circuit).

Figure 12:
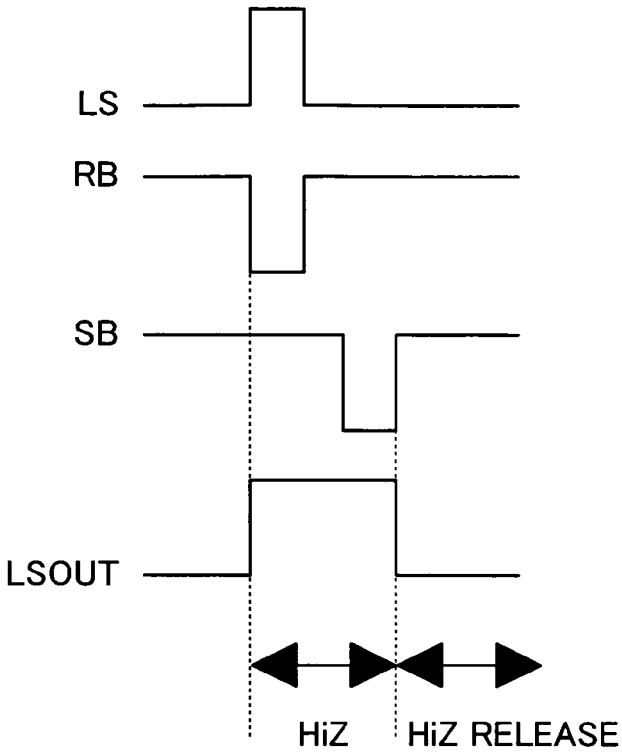
FIG. 12 is a time chart of signals in a control circuit.

The following description deals with the operations of the control circuit 31 in the hold memory circuit 24 and the switch circuit 28, respectively, with reference to FIG. 12. FIG. 12 is a time chart showing the signals in the control circuit 31.

As has been described above, the analog switches in the switch circuit 28 are switched on (in a connecting state) and/or off (not in a connecting state) in response to the display start signal LSOUT outputted from the control circuit 31 in the hold memory circuit 24.

When the horizontal synchronization signal LS, which is supplied to the first input terminal CTRB-LS of the control circuit 31, changes from a "LOW" level to a "HIGH" level, the display start signal LSOUT outputted from the control circuit 31 changes from a "LOW" level to a "HIGH" level, like the horizontal synchronization signal LS (see FIG. 12). The display start signal LSOUT having a "HIGH" level is supplied to a gate of each of the analog switches in the switch circuit 28.

This allows the analog switch to be switched off (not in a connecting state), thereby causing the entire output terminals X1 through Z100 to be in a high-impedance state (HiZ) simultaneously. At this time, a signal, which is supplied to the input terminal RB of the R-SF/F, changes from a "HIGH" level to a "LOW" level.

Then, a horizontal synchronization signal LS (Left-LS) which changes from a "LOW" level to a "HIGH" level is supplied to the second input terminal CTSB-LS of the control circuit 31 via the final delay circuit 32 in the first group. This allows a signal, which is supplied to an input terminal SB of the R-SF/F, to change from a "HIGH" level to a "LOW" level.

Accordingly, the display start signal LSOUT changes from a "HIGH" level to a "LOW" level. The display start signal LSOUT having a "LOW" level is supplied to a gate of each of the analog switches in the switch circuit 28.

On this account, the analog switch is switched on (in a connecting state), thereby causing the high-impedance of the entire output terminals X1 through Z100 to be released simultaneously (Hiz released). This allows the entire output terminals X1 through Z100 to output gradation display voltages at a time in block.

As described above, in the present liquid crystal display apparatus, the hold memory circuit 24 includes the delay circuits 32 for delaying the horizontal synchronization signal LS to be supplied to some of the hold latch cells 33.

Accordingly, the timing of latching the display data varies depending on the hold latch cell 33. This causes the timing of outputting the display data to vary depending on the hold latch cell 33.

On this account, according to the present liquid crystal display apparatus, the timing, when the power source currents are supplied to the respective hold latch cells 33 and the respective level shifter circuits 25, is not uniform, too. Therefore, it is possible to avoid that the peak current, flowing in the line for the power source current (the peak current flowing in the logical power source and the logical GND), becomes excessive. This ensures to avoid the occurrence of the noise due to the excessive peak currents.

Furthermore, the present liquid crystal display apparatus is designed such that the control circuit 31 outputs the display start signal LSOUT after outputting the display data to the level shifter circuit from the entire hold latch cells 33. On this account, when the display start signal LSOUT is outputted, (i) the entire hold latch cells 33 have outputted the display data and (ii) the entire gradation display voltages have been generated by the circuits 25 through 27.

In the present liquid crystal display apparatus, the switch circuit 28, which received the display start signal LSOUT at this stage, outputs the entire gradation display voltages to the entire source signal lines 14 of the liquid crystal panel 1 all at once.

This ensures that the respective gradation display voltages are uniformly outputted at a single timing according to the present liquid crystal display apparatus. Namely, it is possible for the entire source signal lines 14 to simultaneously receive the gradation display voltages, respectively. This allows the liquid crystal panel 1 to be charged by the gradation display voltages in a uniform period of time, for example. Therefore, it is possible to avoid the occurrence of the nonuniform display in the liquid crystal panel 1.

Further, the present liquid crystal display apparatus is designed such that the control circuit 31 outputs the display start signal LSOUT to the liquid crystal panel 1 in accordance with the inputted latest horizontal synchronization signal LS. It is possible to easily adjust and set the timing when the control circuit 31 outputs the display start signal LSOUT, accordingly.

In the present liquid crystal display apparatus, the delay circuit 32 is provided in a routing line via which a horizontal synchronization signal LS is supplied to some of the hold latch cells 33, and receives the horizontal synchronization signal LS and outputs it after elapse of a predetermined time. This allows the horizontal synchronization signal LS to be easily supplied to some of the hold latch cells 33 with delay.

Further, the number of the hold latch cells 33 thus provided is equal to the number of the gradation display voltages (the number of the source signal lines 14). The hold latch cells 33 are divided into the two groups. Each of the groups includes the delay circuits, and each of the delayed horizontal synchronization signals LS is supplied to its corresponding hold latch cell 33 in each of the groups.

On this account, for each of the groups, it is possible to carry out the latch operations with the delay circuits 32. It is possible to shorten the degree of delay with respect to the horizontal synchronization signal LS (the horizontal synchronization signal LS having the longest delay time) that is supplied to the control circuit 31, accordingly. This makes it possible to prolong the period of time between (i) the time when a horizontal synchronization signal LS is supplied to the control circuit 31 and (ii) the time when the next horizontal synchronization signal LS is supplied to the hold latch cell 33 (the delay circuit 32).

Namely, it is possible to prolong the period of time between (i) the time when a horizontal synchronization signal LS is outputted from a source driver SD and (ii) the time when the next horizontal synchronization signal LS is supplied to the source driver SD. This ensures to avoid that the horizontal synchronization signal LS is misidentified by the source driver SD. It is possible to avoid the malfunction of the source driver SD, accordingly.

Further, the present liquid crystal display apparatus is designed such that the horizontal synchronization signal LS is collaterally supplied to the respective groups.

Each of the respective groups is configured such that the delay circuits 32, which are serially connected to each other, form a sequence of delay circuits. Each of the delay circuits 32 is designed so as to output the horizontal synchronization signal LS thus supplied to the corresponding hold latch cell 33 and the next delay circuit 32, respectively, after elapse of a predetermined time. It is possible to set the number of the latch timings made by the hold latch cells 33 in accordance with the number of the delay circuits 32 in each of the groups. This allows the latch timing to be more nonuniform, thereby ensuring to reduce the peak current.

Further, the control circuit 31 is designed so as to receive a horizontal synchronization signal LS that has been delayed by the delay circuit 32 belonging to one specific group (the first group). In addition, the first group is configured so as to include a circuit sequence in which an end delay circuit 32 of the sequence of the delay circuits 32 is connected to the control circuit 31. The end delay circuit 32 is designed so as to output the horizontal synchronization signal LS thus supplied to a hold latch cell 33 connected to the end delay circuit 32 and the control circuit 31, respectively, after elapse of a predetermined time. This makes it possible to easily output the horizontal synchronization signal LS to the control circuit 31 from the delay circuit 32 in the above specific group.

Note that the connecting feature like above is not limited to a specific one. For example, it may be configured such that the horizontal synchronization signal LS is transferred rightward like X51, Y51, . . . , Y100, and Z100 in this order, in place of the configuration in which the horizontal synchronization signal LS is transferred leftward like Z100, Y100, . . . , Z51, and X51 in this order.

The present embodiment has dealt with the configuration in which the end (leftmost) delay circuit 32 in the first group in the hold latch cell 33 outputs the horizontal synchronization signal (the output of the final stage) Left-LS to the second input terminal CTSB-LS of the control circuit 31 (see FIG. 6(*a*)). However, the present liquid crystal display apparatus is not limited to this configuration.

Figure 7:
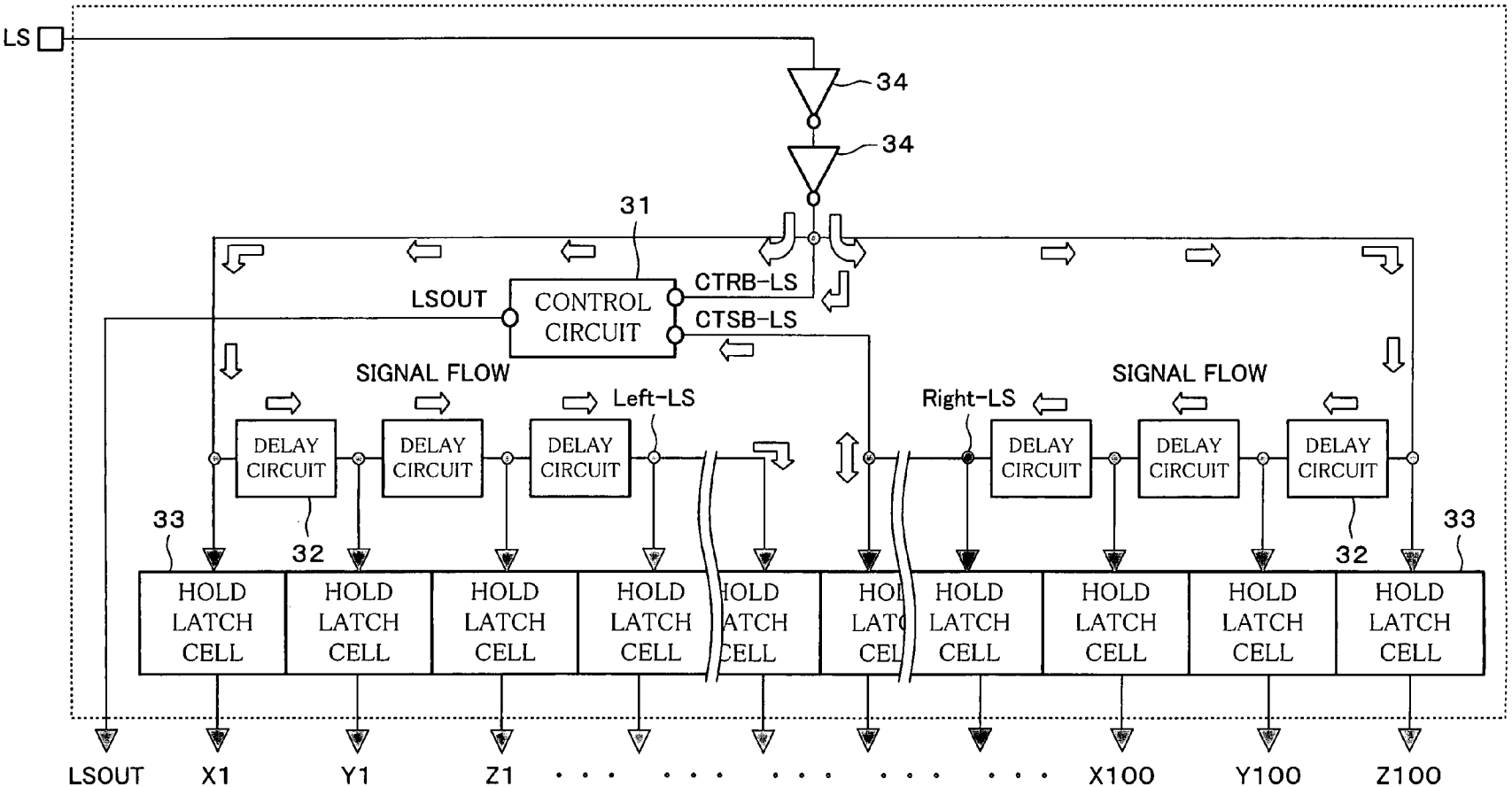
FIG. 7 is a block diagram showing a configuration of a hold memory circuit, FIG. 7 showing a case where the inputting is carried out with respect to a control circuit from a delay circuit on the right side.

For example, as shown in FIG. 7, the present liquid crystal display apparatus may be configured such that the end (rightmost) delay circuit 32 in the second group outputs a horizontal synchronization signal (the output of the final stage) Right-LS to the second input terminal CTSB-LS of the control circuit 31.

Figure 8:
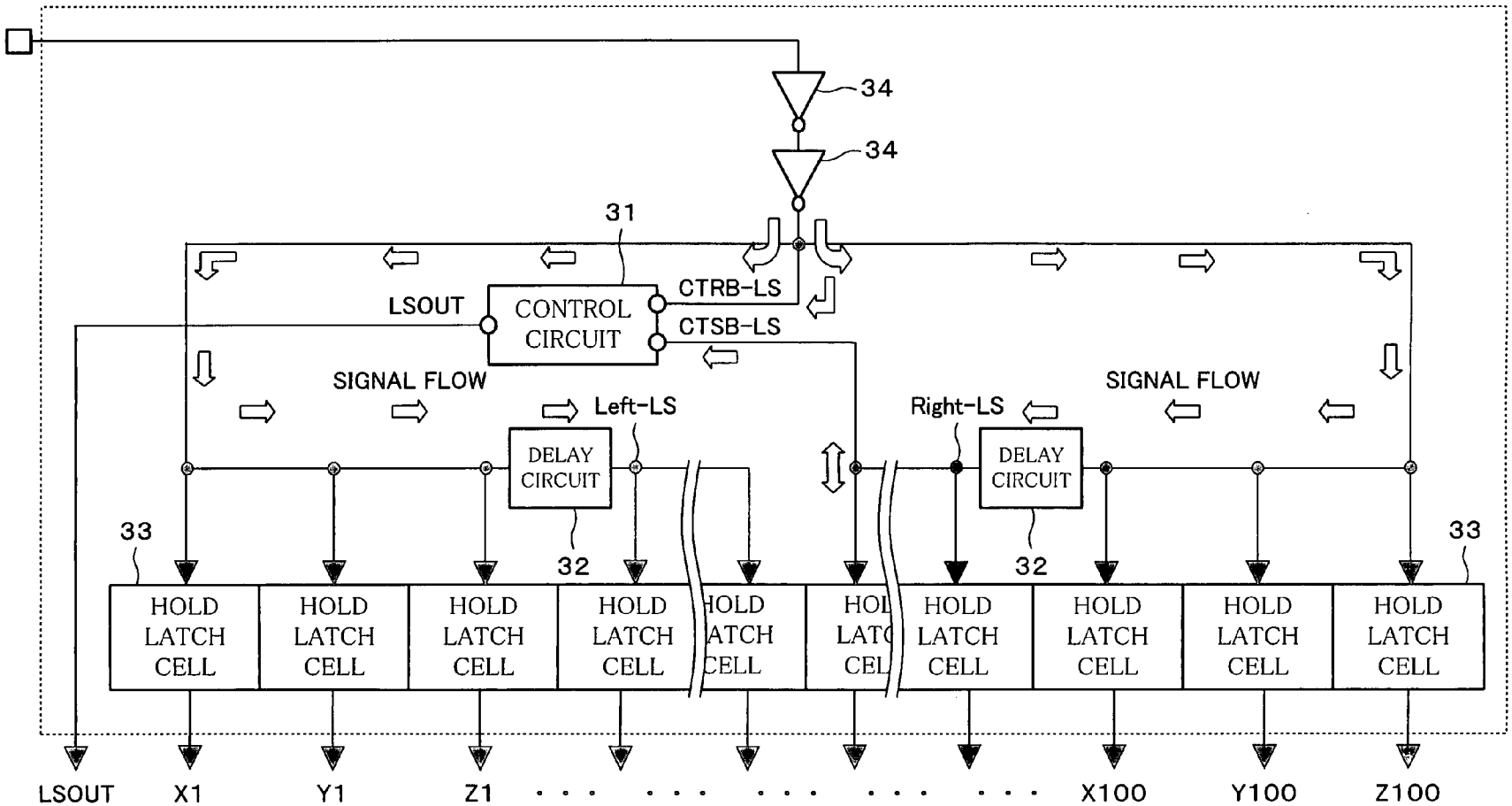
FIG. 8 is a block diagram showing a configuration of a hold memory circuit, FIG. 8 showing a case where a delay circuit is provided in the left and right group, respectively.

Alternatively, as shown in FIG. 8, the present liquid crystal display apparatus may be configured such that a single delay circuit 32 is provided for each group. According to the configuration, such a single delay circuit 32 is connected to a plurality of hold latch cells 33.

Alternatively, the present liquid crystal display apparatus may be configured such that the number of the delay circuits 32 in the first group is different from that of the second group. In this configuration, it is preferable to configure such that the latch signal LS to be supplied to one group having more delay circuits 32 than the other group is supplied to the first input terminal CTRB-LS of the control circuit 31.

The present embodiment deals with the case where the hold latch cells 33 in the hold latch memory circuit 24 are divided into the left and right groups. However, the present invention is not limited to this, for example, the hold latch cells 33 may not be divided or may be divided into groups of not less than 3.

The present embodiment deals with the case where the hold memory circuit 24 includes two inverter circuits 34. However, the present invention is not limited to this, for example, the hold memory circuit 24 may include a single inverter circuit 34 or may include inverter circuits of not less than 3.

In the present liquid crystal display apparatus, the drivers IC 2 and IC 3 are electrically connected to ITO (Indium Tin Oxide) terminals in the liquid crystal panel 1. This electrical connection may be realized by mounting of TCP (Tape Carrier Package), for example. The TCP is obtained by mounting IC chips on a film including wires.

The electrical connection may be realized, for example, by the mounting in which thermo compression bonding of IC chips is carried with respect to ITO terminals of the liquid crystal panel 1 via an ACF (Anisotropic Conductive Film).

The controller 4, the liquid crystal driving power source 5, and the drivers IC 2 and IC 3 may be configured by one chip or by a couple of chips so as to downsize the present liquid crystal display apparatus.

Further, the present embodiment deals with the case where the liquid crystal display apparatus is used as a display module. However, the present invention is not limited to this, provided that the displaying is carried out in accordance with the display data.

As described above, a driving apparatus in accordance with the present invention is designed so as to include: (i) a memory circuit including latch cells, each latching and outputting display data, corresponding to one horizontal synchronization period, in accordance with an inputted horizontal synchronization signal; (ii) a conversion circuit that generates a plurality of driving signals in accordance with the display data outputted from the latch cells, the driving signals being for driving a display section; and (iii) a switch circuit that receives the driving signals generated by the conversion circuit and outputs the driving signals to the display section, wherein the memory circuit includes: (a) a delay circuit that delays an outputting of the horizontal synchronization signal to some of the latch cells; and (b) a control circuit that outputs a display start signal to the switch circuit after the entire latch cells output the display data, respectively, the switch circuit simultaneously outputting to the display section, in response to the display start signal, the driving signals received from the conversion circuit.

The present driving apparatus functions as a so-called source driver that outputs the driving signals to a display section such as a liquid crystal panel in response to a horizontal synchronization signal.

Here, the driving signals indicate signals to be supplied to source lines (source signal lines) of the display section. The number of the driving signals is determined by the number of the source lines in the display section and/or the number of colors of the signal.

More specifically, in the present invention, the latch cells in the memory circuit latch the display data, corresponding to one horizontal synchronization period, in accordance with the horizontal synchronization signal. The conversion circuit converts the display data thus latched into the driving signals, and outputs them to the display section via the switch circuit.

Note that the conversion circuit indicates a circuit that generates the driving signals. The conversion circuit is, for example, a level shifter circuit that carries out a level conversion of the level of the display data or a D/A conversion circuit that selects an analog voltage in accordance with the display data that has been subject to the level conversion.

In especial, in the present invention, the memory circuit includes a delay circuit that delays an outputting of the horizontal synchronization signal to some of the latch cells.

Accordingly, it is possible that the timing, at which the latch cell latches the display data, is not a specified one. Because of this, the timing (the timing of generating the driving signals) of outputting the display data to the conversion circuit differs from latch cell to latch cell.

This gives rise to the similar nonuniformity of the timing of supplying the power source current for driving the latch cell and the conversion circuit. This ensures to avoid that the excessive peak current flows in the line via which the power source current flows. The excessive peak current indicates such a current that drives the entire latch cells and the conversion circuit. Accordingly, it is possible to avoid that the noise occurs due to the peak current.

Further, in the present driving apparatus, the memory circuit includes a control circuit that outputs a display start signal (an output timing signal) to the switch circuit.

In especial, in the present driving apparatus, the control circuit is designed so as to output a display start signal after the entire latch cells output the display data to the conversion circuit. Namely, when outputting of a display start signal, the entire latch cells have already outputted the display data and the conversion circuit has generated the entire driving signals.

At this stage, upon receipt of the display start signal, the switch circuit of the present driving apparatus is designed so as to output, all at once, the entire driving signals to the entire source lines of the display section.

According to the present driving apparatus, there occurs no nonuniform output timing in the driving signal. In other words, the driving signals can be simultaneously outputted to the entire source lines of the display section. This allows the display section to be charged by the driving signals within a single specified period of time. Thus, it is possible to avoid that there occurs a nonuniform displaying in the display section.

In the present driving apparatus, it is preferable for the control circuit to be designed so as to output a display start signal to the display section in accordance with a latest horizontal synchronization signal to be supplied to the latch cell. It is possible to easily adjust and set the timing when the control circuit outputs the display start signal, accordingly.

In the present driving apparatus, it is also preferable for the delay circuit to be designed so as to be provided in a routing line via which a horizontal synchronization signal is supplied to some of the latch cells, and so as to receive the horizontal synchronization signal and output it after elapse of a predetermined time. This allows the horizontal synchronization signal to be easily supplied to some of the latch cells with delay.

It is also preferable that the number of the latch cells is equal to that of the driving signals. In this configuration, it is preferable (i) that the latch cells are divided into a plurality of groups which have their own delay circuit, and (ii) that a delayed horizontal synchronization signal is supplied to at least one latch cell in each group.

This allows the latch operation using the delay circuit to be carried out for each group. It is possible to shorten the degree of delay with respect to the horizontal synchronization signal (the horizontal synchronization signal having the longest delay time) that is supplied to the control circuit, accordingly. This makes it possible to prolong the period of time between (i) the time when a horizontal synchronization signal is supplied to the control circuit and (ii) the time when the next horizontal synchronization signal is supplied to the latch cell (the delay circuit). This ensures to avoid that the horizontal synchronization signal is misidentified by the control circuit or the latch cell (the delay circuit). It is possible to avoid the malfunction of the driving circuit, accordingly.

In this case, it is also preferable that the horizontal synchronization signal is collaterally supplied to each group.

In the case where each of the group includes a plurality of delay circuits, it is preferable to configure the delay circuits so as to be serially connected to each other and to form a sequence of delay circuits. It is preferable to design such that each of the delay circuits outputs the horizontal synchronization signal thus supplied to (i) a latch cell connected to the above each delay circuit and (ii) the next delay circuit, respectively, after elapse of a predetermined time.

It is possible to set the number of the latch timing made by the hold latch cells in accordance with the number of the delay circuits in each of the groups. This allows the latch timing to be more nonuniform, thereby ensuring to reduce the peak current.

Further, the control circuit is designed so as to receive a horizontal synchronization signal that has been delayed by a delay circuit belonging to one specific group.

In addition, the specific group is configured so as to include a circuit sequence in which an end delay circuit of the sequence of the delay circuits is connected to the control circuit. The end delay circuit is designed so as to output the horizontal synchronization signal thus supplied to a latch cell connected to this end delay circuit and the control circuit, respectively, after elapse of a predetermined time. This makes it possible to easily output the horizontal synchronization signal to the control circuit from the delay circuit in the specific group.

It is also preferable that the specific group includes a circuit sequence composed of maximum number of delay circuits among the groups.

It is possible to say that the object of the present invention to provide a driving apparatus and a display module including such a driving apparatus. Such a driving apparatus can reduce the peak value of the power source current, can avoid that the horizontal synchronization signal (the latch signal) is misidentified, and can avoid that the output timing becomes nonuniform.

It is possible to describe the configuration shown in FIG. 13 as follows. More specifically, an X driver shown in FIG. 13 includes a shift register 101, a K-bit (here, k=4) parallel latch A-circuit 102, a latch B-circuit 103 carrying out latch operation in block, a decoder 104 for decoding 4-bit data DI1 through DI4 so as to generate 16 data DO1 through DO15, a level shifter 105 for boosting an output signal of the decoder 104 up to a liquid crystal driving voltage, and an analog switch group 106, including analog switches whose control terminals receive output signals from the level shifter 105, for selecting one of gradation signals of $2^{4=16}$ levels, the output signals being supplied to control terminals of respective analog switches in the analog switch group 106.

Note that 4 half latches 107 are included in respective stages of the latch A-circuit 102 and that 4 half latches 108 are included in respective stages of the latch B-circuit 103. This allows the respective stages of the latch A-circuit 102 to fetch in 4-bit data PD1 through PD4 in sync with an output Qn (n: an integer of not less than 1 and not more than M) of a corresponding stage of the shift register 101. The data thus latched are fetched in, in block, by the latch B-circuit 103. The data latched by the latch B-circuit 103 are decoded for the respective stages by the decoder 104.

When one of the data DO1 through DO15 is selected in accordance with the data DI1 through DI4, one of 16 analog switches in the analog switch group 106 is selected via the level shifter 105. This allows a corresponding one of the gradation 16 levels GSV0 through GSV15 of the liquid crystal driving voltage that is externally supplied to the source line as an output of the driver.

Figure 13:
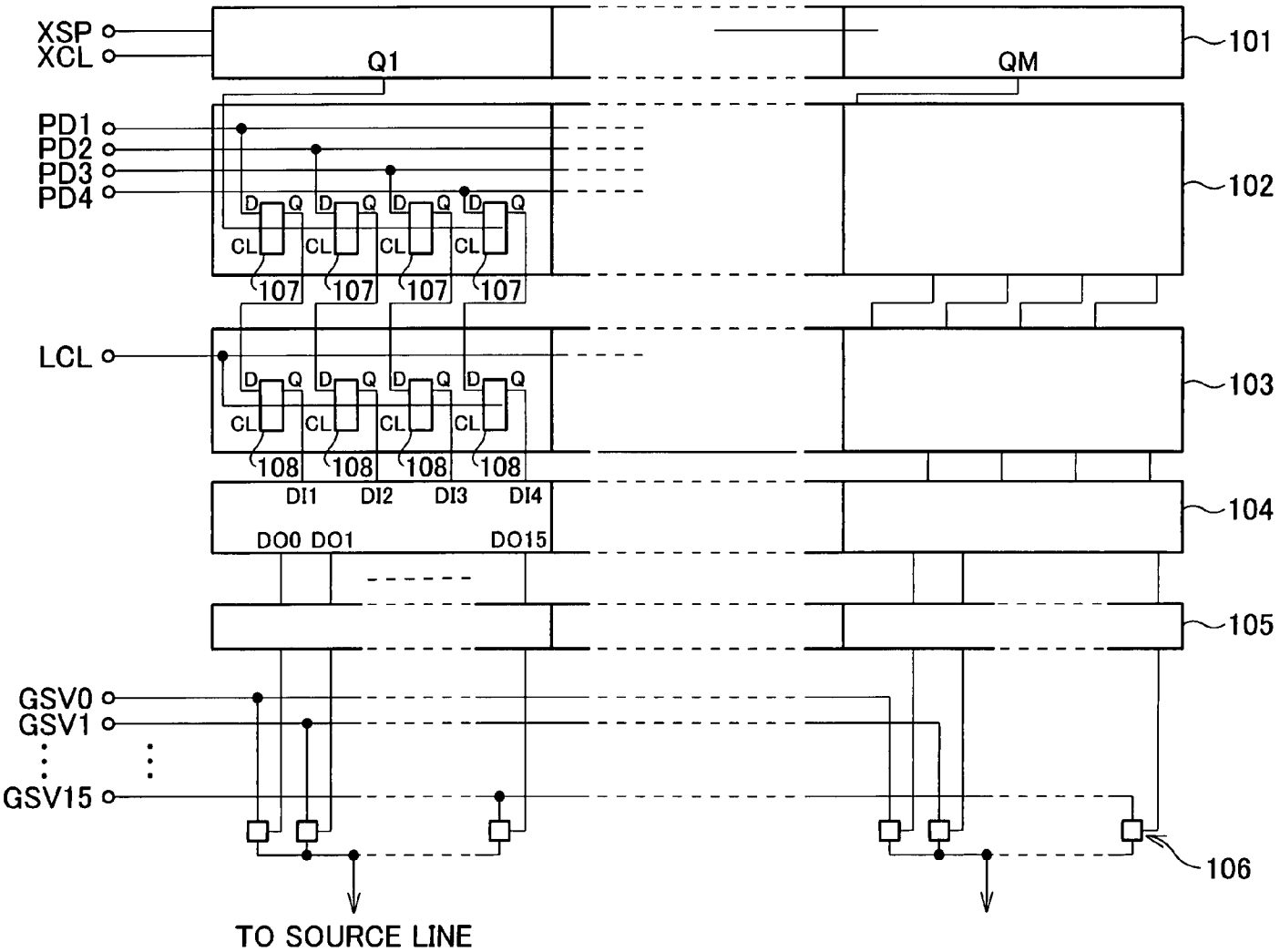
FIG. 13 is a block diagram showing one example of a conventional driving circuit.
Figure 14:
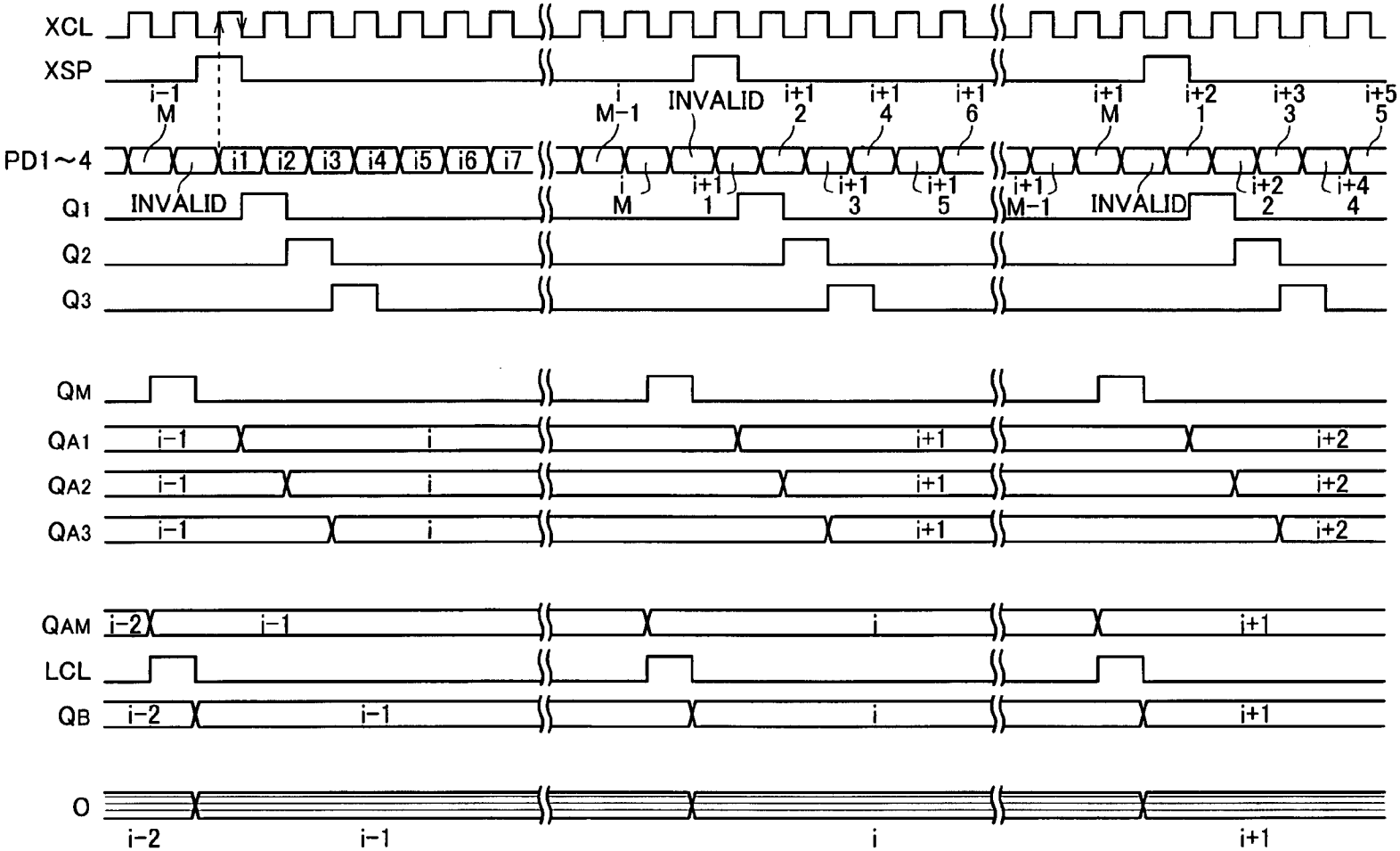
FIG. 14 is a time chart of signals during driving of the driving circuit shown in FIG. 13.

It is also possible to say that FIG. 14 is a timing chart showing signals of the X driver shown in FIG. 13 during driving. The following description deals with the main signals such as input signals, internal signals, and output signals in the X driver.

The shift register 101 receives a clock signal XCL and a start pulse XSP (input signals), respectively. The shift register 101 supplies internal output signals Q1 through QM to corresponding stages of the latch A-circuit 102, respectively. In FIG. 14, a symbol Qa indicates an output from the a-th stage of the shift register 101.

Data PD1 through PD4 are input signals that are supplied to the first stage of the latch A-circuit 102. The Data PD1 through PD4 form a 4-bit digital signal. Signals QA1 through QAM are outputted from the latch A-circuit 102. Here, QAa ($1 \leqq a \leqq M$) correspond to a signal outputted from the a-th stage of the latch A-circuit 102.

The latch A-circuit 102 sweeps the 4-bit data PD1 through PD4 in response to a rising edge of an output signal from the shift register 101, so as to output the signals QA1 through QAM.

The latch B-circuit 103 receives a latch clock input signal LCL. The latch B-circuit 103 sweeps the signal QAa ($1 \leqq a \leqq M$) outputted from the latch A-circuit 102 in response to a falling edge of the latch clock input signal LCL, so as to output a signal QB. Then, an analog final output signal 0 is outputted via the decoder 104, the level shifter 105, and the analog switch group 106. Symbol "i" in the signals indicates data of i-row.

Conventionally, pursuant to the demand that a large-sized screen be produced, liquid crystal display apparatuses have been developed so as to be exploited in screens for TVs or PCs. Meanwhile, small and medium liquid crystal display apparatus and liquid crystal driving apparatus have recently been developed such that the liquid crystal display apparatus is exploited in the portable terminal, such as a mobile phone, which has gained market share rapidly. With regard to the liquid crystal panel and liquid crystal driving circuit, strongly desired are downsizing, weight saving, low power consumption including battery-driving, multiple-output, speeding up, improvement in display quality, and low cost.

Figure 15:
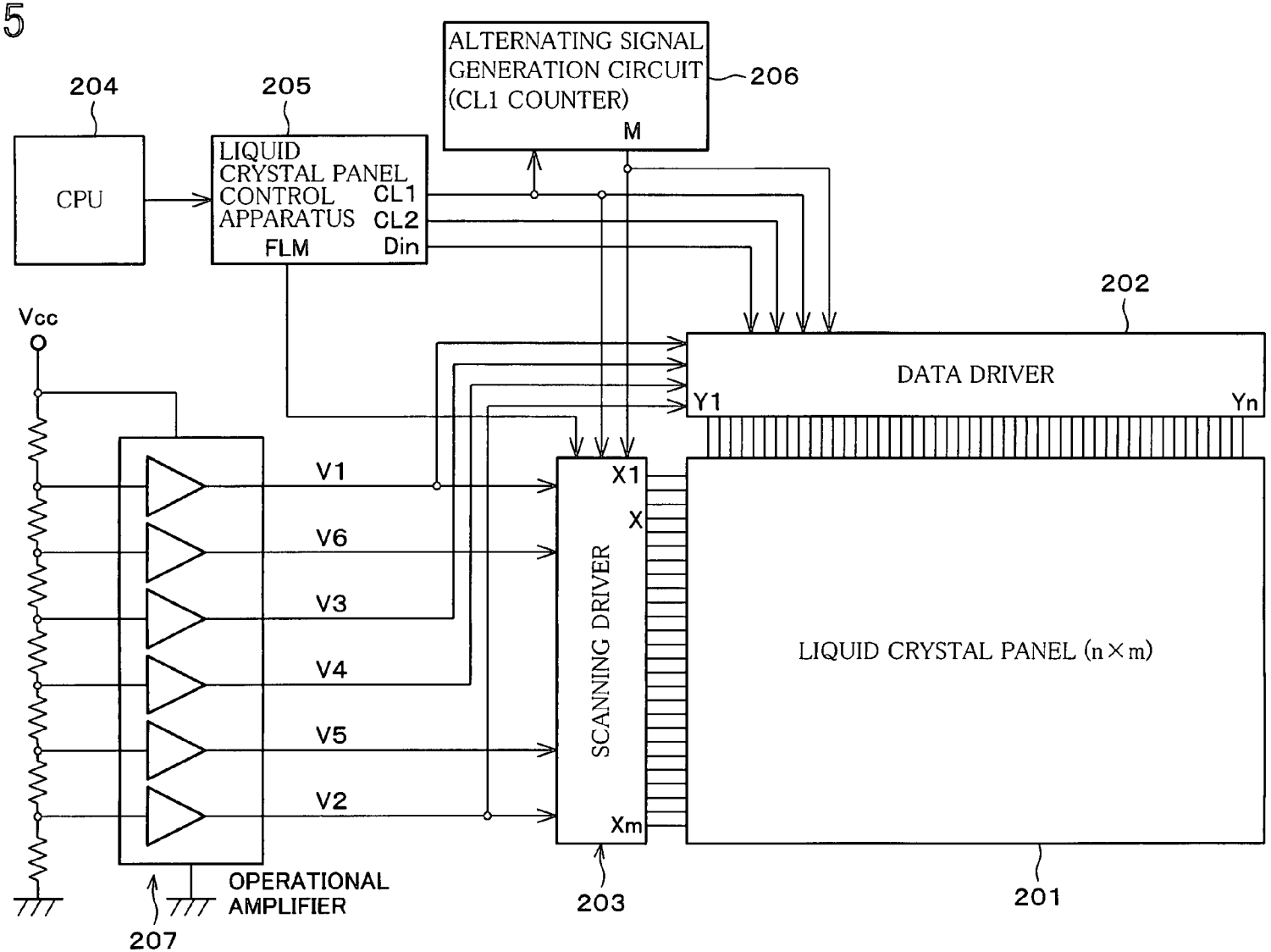
FIG. 15 is an explanatory diagram showing a main part of a liquid crystal display apparatus using another conventional driving circuit.
Figure 16:
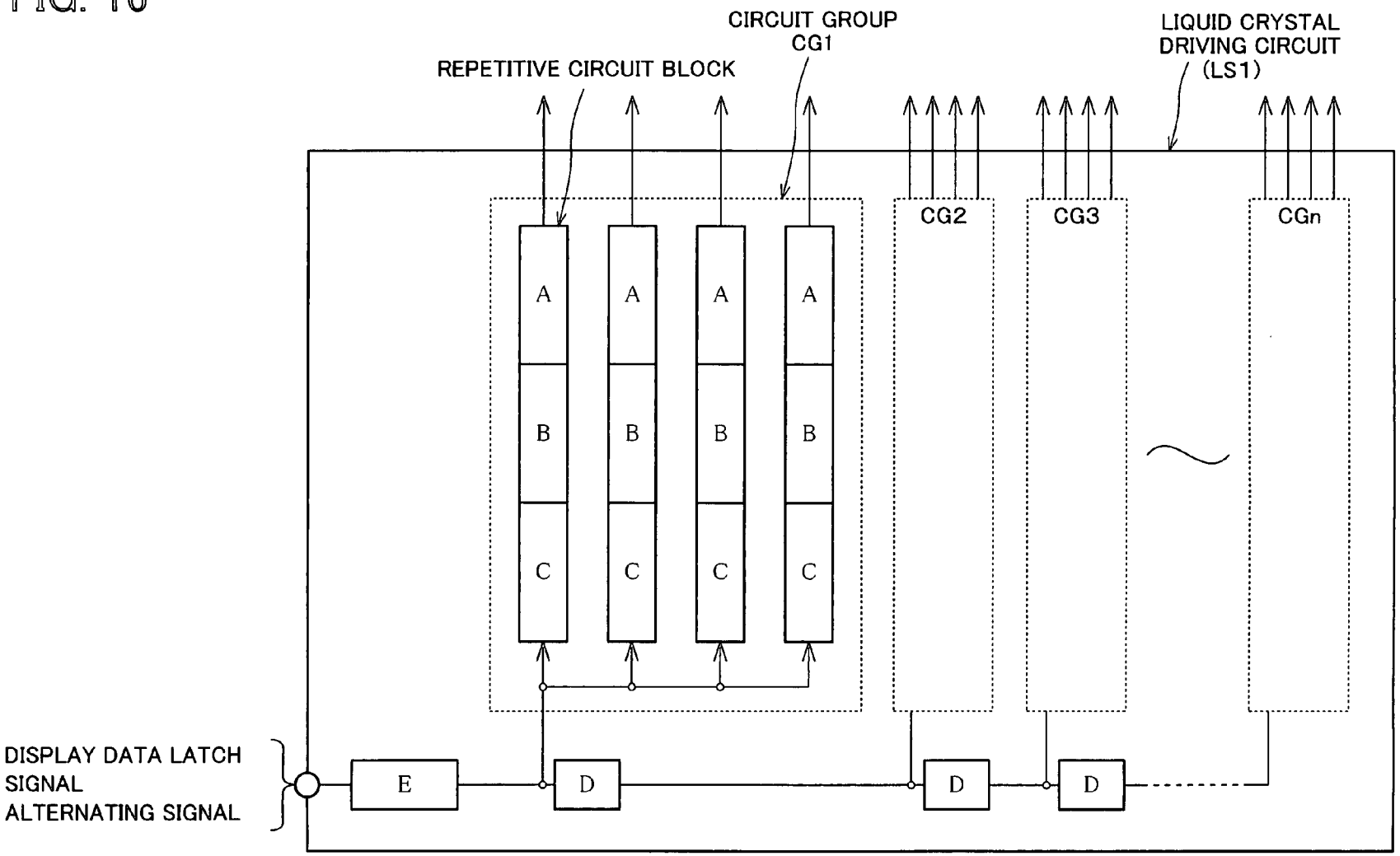
FIG. 16 is an explanatory diagram showing a configuration of a source driver in the liquid crystal display apparatus shown in FIG. 15.
Figure 17:
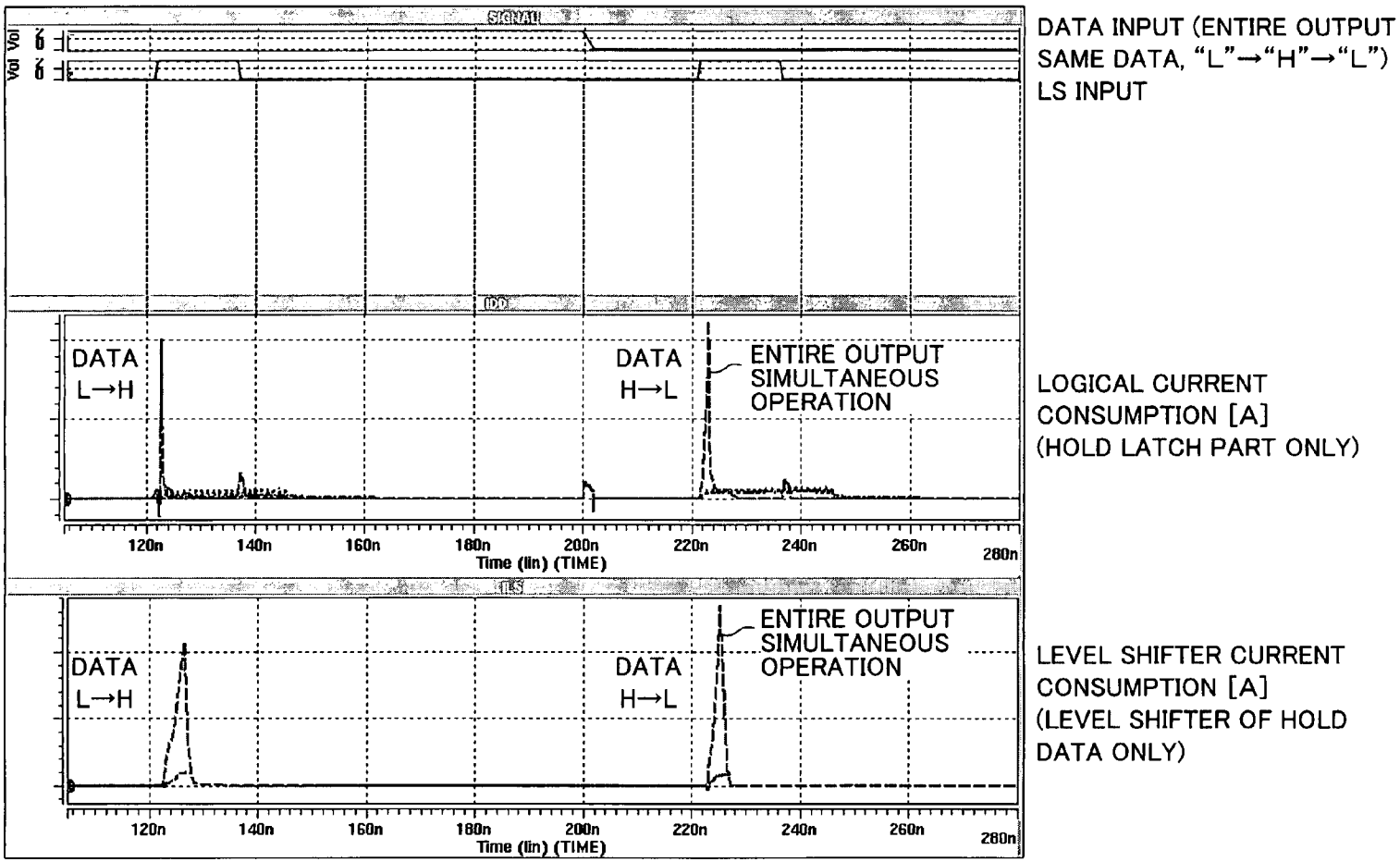
FIG. 17 is an explanatory diagram showing the peak values of the electric current flowing in a GND line in a logical circuit and a level shifter circuit section, respectively.
Figure 18:
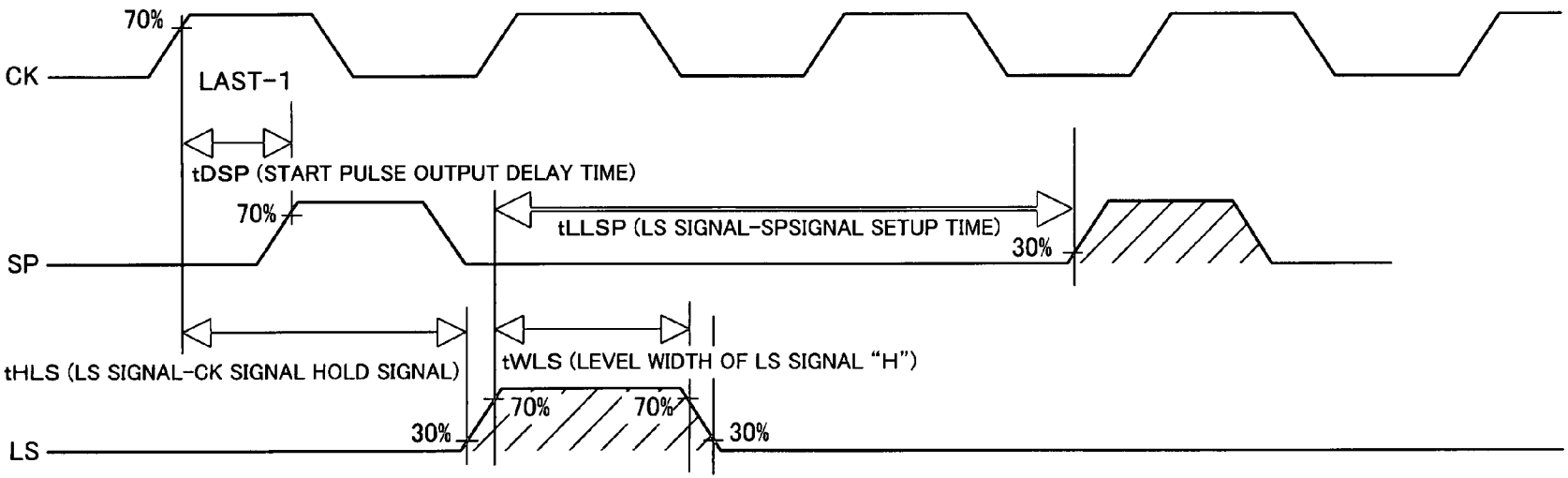
FIG. 18 is a time chart showing a clock signal CK, a start pulse SP, and a latch signal LS, respectively, during delaying a latch signal.

Further, the alternating signal generation circuit 206 shown in FIG. 15 may have a configuration in which the clock pulse CL1 corresponding to the timing of selecting the scanning lines is counted and the polarity of the alternating signal M is changed for every plural scanning lines. The scanning driver 203 may have a configuration in which (i) a shift register that carries out a shift operation in accordance with the clock pulse CL1 is included, and (ii) the driving voltage V1 or V5 and the driving voltage V2 or V6, which are generated by a driving voltage generation circuit in response to an output signal from the shift register, are switched in response to the alternating signal so as to be supplied to corresponding scanning line electrodes, so as to cause the respective scanning line electrodes to have a selection/non-selection level. In the case where the polarity is changed for every plural scanning lines during a frame, the alternating signal M causes the selection level to be such as the driving voltage V2 in place of the driving voltage V1 and the non-selection level to be such as the driving voltage V6 in place of the driving voltage V5.

Further, it is also possible to say that the signal processing in the configuration shown in FIG. 1 is dealt with as follows. More specifically, the input latch circuit 21 receives and latches the display data DR, DG, and DB outputted from the controller 4. Meanwhile, the start pulse SP is sequentially transmitted in the shift register circuit 22 in sync with the clock signal CK. In response to control signals outputted from the respective stages of the shift register circuit 22, the sampling memory 23 fetches in the display data DR, DG, and DB, which are outputted from the input latch circuit 21, in a time-sharing manner, and temporarily stores them.

When the sampling memory 23 fetches in the display data DR, DG, and DB corresponding to one line in sync with the timing of the horizontal synchronization signal LS, the display data DR, DG, and DB stored in the sampling memory 23 are stored and latched by the hold memory 24. The display data DR, DG, and DB thus latched are maintained until the next horizontal synchronization signal LS is supplied.

Thereafter, the level shifter circuit 25 converts the level of the display data DR, DG, and DB thus latched into the level of the maximum driving voltage that is supplied to the liquid crystal panel 1, and then supplies it to the D/A conversion circuit 26. In accordance with the display data DR, DG, and DB, the D/A conversion circuit 26 selects one of the gradation display voltages (voltages of 64-level when 64-gradation display is carried out) that (i) are generated by the reference voltage generation circuit 29 in accordance with a reference voltage outputted from the liquid crystal driving power source 5 and (ii) are supplied to the source signal lines 14 in the liquid crystal panel 1. The D/A conversion circuit 26 outputs the voltage thus selected via the output circuit 27 and the switch circuit 28.

Thus, each source driver SD for 64-gradation display supplies an analog signal corresponding to the gradation level to the liquid crystal panel 1 in accordance with the display data DR, DG, and DB. This allows the 64-gradation display to be carried out.

In the present liquid crystal display apparatus, like the hold latch cell 33, the level shifter circuit 25 also operates with delay corresponding to the delay due to the delay circuit 32. This allows the peak current that flows in the logical power source (GND line) to be reduced.

It is also possible to say that FIG. 8 shows a configuration in which (i) a single delay circuit 32 is provided for each of the left and right groups, and (ii) such a single delay circuit 32 is connected to a plurality of hold latch cells 33. When the number of the delay circuits 32 in the left group (on the first stage side) is different from that of the right group (on the final stage side), it is preferable to configure such that a latch signal LS, to be supplied to the group having more delay circuits 32, is supplied to the second input terminal CTRB-LS of the control circuit 31.

As described earlier, the logical power source and the logical GND are connected to the logical circuits and the hold memory circuit 24. This connection may indicate that the hold memory circuit 24 includes the delay circuits 32 for the purpose of avoiding that the noise, occurred in the level shifter circuit 25 that switches based on the high-voltage driving, does not increase.

It is also possible to deal with the present embodiment as follows. A source driver SD in accordance with the present embodiment, as shown in FIG. 1, includes (i) a hold memory circuit 24 for latching display data D corresponding to one horizontal synchronization period in response to the horizontal synchronization signal LS, and (ii) a switch circuit 28 for outputting a plurality of driving signals into which a conversion section, such as a level shifter circuit 25, D/A conversion circuit 25, and an output circuit 27, converts the display data D thus latched. This allows the liquid crystal panel 1 to be driven by the driving signals.

Further, as shown in FIG. 6(*a*), in the source driver SD, the hold memory circuit 24 includes (i) a plurality of delay circuits 32 for delaying an inputted horizontal synchronization signal LS, (ii) a plurality of hold latch cells 33 each for latching the display data D in response to the horizontal synchronization signal LS that has been delayed by the delay circuit 32, and (iii) a control circuit 31 for outputting to the switch circuit 28 a display start signal LSOUT upon receipt of the horizontal synchronization signal LS that has been delayed by the delay circuit 32. In accordance with the display start signal LSOUT, the switch circuit 28 simultaneously outputs the driving signals to the liquid crystal panel 1 via the output terminals X1 through Z100. Note that the number of the driving signals is determined in accordance with the number of the pixels of the liquid crystal panel 1, the number of colors (three colors of R, G, and B, for example) that the display data D indicates, or other factor.

By latching the display data D in response to the horizontal synchronization signal LS that has been delayed by the delay circuit 32, the display data D outputted from the hold memory circuit 24 is delayed with delay corresponding to the delay due to the delay circuit 32. Accordingly, it is possible to disperse the power source current that is supplied to the source driver SD, thereby reducing the peak values of the power source current.

Further, since the switch circuit 28 is provided for simultaneously outputting the plural driving signals in response to the display start signal LSOUT, it is possible to avoid that the timing when the driving signals are outputted is not uniform. Therefore, for example, it is possible to avoid that the time required for the liquid crystal panel 1 to be charged in substantially a uniform period of time, thereby providing a display module enabling to carry out a uniform display.

It is preferable that the display start signal LSOUT is a signal indicating how the horizontal synchronization signal LS changes before and after the delay circuit 32 receives the horizontal synchronization signal LS. This allows the switch circuit 28 to learn about the timing of outputting the driving signals from the level change in the horizontal synchronization signal LS between "High" and "Low". It is possible for the switch circuit 28 to simultaneously output the plural driving signals, without complex configuration.

Further, as shown in FIG. 6(*a*), the following configuration is preferable. More specifically, the number of the hold latch cells 33 is equal to that of the driving signals (the number of output terminals X1 through Z100). The hold latch cells 33 are divided into a plurality of groups. In the embodiment, the hold latch cells 33 are divided into (i) the first group in which the signals flow toward the right and (ii) the second group in which the signals flow toward the left. At least one delay circuit 32 is provided for each group (three delay circuits 32 are provided for each group in FIG. 6(*a*)). The horizontal synchronization signal LS is supplied to the hold latch cell 33 and the corresponding delay circuit 32, respectively. Note that the number of the groups to be divided is not limited to a specific one. This configuration ensures to carry out the latch operation with the use of the delay circuits 32.

Although the delay circuit 32 delays the horizontal synchronization signal LS, it is possible to prolong the period of time between (i) the time when a horizontal synchronization signal LS is supplied to the control circuit 31 and (ii) the time when the next horizontal synchronization signal LS is supplied to the control circuit 31. This ensures to avoid that the horizontal synchronization signal LS is misidentified, and that the source driver SD erroneously operates.

It is preferable that the control circuit 31 receives a horizontal synchronization signal LS that has been delayed by the delay circuit 32 corresponding to either one of the groups. Note that, in FIG. 6(*a*), the horizontal synchronization signal Left-LS is supplied to the control circuit 31, thereby ensuring to generate the display start signal LSOUT in accordance with one horizontal synchronization signal LS that has been delayed.

Accordingly, it is ensured to simultaneously output the entire driving signals, for example, by supplying the display start signal LSOUT to the switch circuit 28 with the use of a horizontal synchronization signal LS having the longest delay time (a horizontal synchronization signal LS that has gone through maximum number of delay circuits 32).

In the case where the number of the delay circuits 32 varies depending on the group, it is preferable that either one group from which the control circuit 31 receives the horizontal synchronization signal LS is either one group including maximum number of corresponding delay circuits 32. This ensures to supply the display start signal LSOUT with the use of a horizontal synchronization signal LS having the longest delay time. Therefore, it is ensured to simultaneously output the entire driving signals.

Further, it is also possible to describe a driving apparatus in accordance with the present invention as follows. More specifically, the driving apparatus of the present invention includes: (a) a hold memory circuit section that latches display data, corresponding to one horizontal synchronization period, in accordance with an inputted horizontal synchronization signal; and (b) a switch circuit section that outputs to a display section a plurality of driving signals into which the display data thus latched is converted by a conversion circuit, the display section being driven in accordance with the driving signals, the hold memory circuit section including: (i) delay means for delaying the horizontal synchronization signal that has been supplied; (ii) hold latch means for latching the display data in accordance with the horizontal synchronization signal that has been delayed by the delay means; and (iii) control means for outputting a display start signal to the switch circuit section, upon receipt of the horizontal synchronization signal that has been delayed by the delay means, the switch circuit section simultaneously outputting the driving signals in accordance with the display start signal.

Note that the number of the driving signals is determined in accordance with the number of the pixels of the display section, the number of colors that the signal indicates (three colors of R, G, and B, for example), or other factor. Note also that the conversion section that converts the latched display data into the driving signal indicates a level shifter circuit that carries out the level conversion of an inputted signal, for example. The conversion section also indicates a D/A conversion circuit or other circuit that selects, in accordance with the inputted signal, one of analog voltages for gradation display use that are generated based on a reference signal.

With the configuration, the display data is latched in response to a horizontal synchronization signal that has been delayed by delay means. This causes the hold memory circuit section to output the display data with delay corresponding to the delay due to the delay means. Accordingly, it is possible to disperse the power source currents that are supplied to the driving circuits, thereby reducing the peak value of the power source current.

Further, there is provided a switch circuit section for simultaneously outputting the plural driving signals in response to the display start signal. This ensures to avoid that the timing of outputting the driving signals is not uniform. This allows the display section to be charged by the driving signals within substantially a single specified period of time. Further, it is possible to provide a display module enabling to carry out a uniform display.

It is preferable that (a) the number of the hold latch means in the driving apparatus is equal to the number of the driving signals, (b) the hold latch means are divided into a plurality of groups, (c) at least one delay means is provided for each group, and (d) the horizontal synchronization signal is supplied to the hold latch means and the corresponding delay means for each group.

With the configuration, it is possible to carry out the latch operation for each group with the use of the delay means.

Accordingly, although the delay means delay the horizontal synchronization signal LS, it is possible to prolong the period of time between (i) the time when a horizontal synchronization signal LS is supplied to the control means and (ii) the time when the next horizontal synchronization signal LS is supplied to the control means (the source driver). This ensures to avoid that the horizontal synchronization signal is misidentified by the source driver and that the driver circuit (the source driver) erroneously operates.

It is preferable that the driving apparatus is designed such that the control means receives the horizontal synchronization signal that has been delayed by the delay means corresponding to one of the groups. With the configuration, one horizontal synchronization thus delayed can cause the display start signal to be generated.

Accordingly, it is ensured to simultaneously output the entire driving signals, for example, by supplying the display start signal to the switch circuit section with the use of a horizontal synchronization signal having the longest delay time. Further, when the groups have respective different number of delay means, it is preferable that either one group is either one group including maximum number of corresponding delay means. With the configuration, it is possible to supply the display start signal to the switch circuit section with the use of the horizontal synchronization signal having the longest delay time. It is ensured to simultaneously output the entire driving signals, accordingly.

It is preferable in the driving apparatus that the display start signal is a signal indicating how the horizontal synchronization signal changes before and after the delay means receives the horizontal synchronization signal. This allows the switch circuit section to learn about the timing of outputting the driving signals from the level change in the horizontal synchronization signal between "High" and "Low". It is possible for the switch circuit section to simultaneously output the plural driving signals, without complex configuration.

Further, a display module in accordance with the present invention includes the driving apparatus and a display section for displaying the display data. Accordingly, in the module, it is possible to disperse the power source currents to be supplied to a driving circuit. Therefore, it is possible to reduce the peak value of the power source currents. It is also possible to avoid that the timing when the driving signals are outputted is not uniform, thereby providing a display module enabling to carry out a uniform display. Further, it is possible to avoid that the horizontal synchronization signal is misidentified, thereby providing a display module that never erroneously operates.

The invention being thus described, it will be obvious that the same way may be varied in many ways. Such variations are not to be regarded as a departure from the spirit and scope of the invention, and all such modifications as would be obvious to one skilled in the art are intended to be included within the scope of the following claims.

What is claimed is:

1. A driving apparatus, comprising:

a memory circuit including latch cells, each latching and outputting display data, corresponding to one horizontal synchronization period, in accordance with an inputted horizontal synchronization signal;

a conversion circuit that generates a plurality of driving signals in accordance with the display data outputted from the latch cells, the driving signals being for driving a display section; and a switch circuit that receives the driving signals generated by said conversion circuit and outputs the driving signals to said display section, wherein said memory circuit includes:

a delay circuit that delays an outputting of the horizontal synchronization signal to some of said latch cells; and a control circuit that outputs a display start signal to said switch circuit after said entire latch cells output the display data, respectively, said switch circuit simultaneously outputting to said display section, in response to the display start signal, the driving signals received from said conversion circuit.

2. The driving apparatus as set forth in claim 1, wherein said control circuit outputs the display start signal to said display section in response to a latest horizontal synchronization signal to be supplied to a latch cell.

3. The driving apparatus as set forth in claim 2, wherein said delay circuit is provided in a routing line via which a horizontal synchronization signal is supplied to some of said latch cells, and receives the horizontal synchronization signal and outputs it after elapse of a predetermined time.

4. The driving apparatus as set forth in claim 3, wherein said latch cells are provided as many as the driving signals.

5. The driving apparatus as set forth in claim 4, wherein said latch cells are divided into a plurality of groups, each of the groups includes at least one delay circuit, and at least one latch cell in each group receives a horizontal synchronization signal that has been delayed.

6. The driving apparatus as set forth in claim 5, wherein the horizontal synchronization signal is collaterally to the respective groups.

7. The driving apparatus as set forth in claim 6, wherein said control circuit receives a horizontal synchronization signal that has been delayed by a delay circuit belonging to a specific group.

8. The driving apparatus as set forth in claim 7, wherein:

said delay circuits form a sequence in the group, and each of said delay circuits outputs the horizontal synchronization signal thus supplied to a hold latch cell and a next delay circuit that are connected to said each delay circuit, respectively, after elapse of a predetermined time.

9. The driving apparatus as set forth in claim 8, wherein:

the specific group includes a circuit sequence in which an end delay circuit of the sequence of said delay circuits is connected to said control circuit, and the end delay circuit outputs the horizontal synchronization signal thus supplied to said hold latch cell that is connected to said end delay circuit and said control circuit, respectively, after elapse of a predetermined time.

10. The driving apparatus as set forth in claim 9, wherein the sequence of said delay circuits in the specific group includes maximum number of delay circuits among the groups.

11. A display module comprising a driving apparatus and a display section that displays display data, said driving apparatus comprising:

a memory circuit including latch cells, each latching and outputting display data corresponding to one horizontal synchronization period, in accordance with an inputted horizontal synchronization signal;

a conversion circuit that generates a plurality of driving signals in accordance with the display data outputted from the latch cells, the driving signals being for driving a display section; and a switch circuit that receives the driving signals generated by said conversion circuit and outputs the driving signals to said display section, wherein said memory circuit includes:

a delay circuit that delays an outputting of the horizontal synchronization signal to some of said latch cells; and a control circuit that outputs a display start signal to said switch circuit after said entire latch cells output the display data, respectively, said switch circuit simultaneously outputting to said display section, in response to the display start signal, the driving signals received from said conversion circuit.

12. A driving apparatus, comprising:

a hold memory circuit section that latches display data, corresponding to one horizontal synchronization period, in accordance with an inputted horizontal synchronization signal; and a switch circuit section that outputs to a display section a plurality of driving signals into which the display data thus latched is converted by a conversion circuit, said display section being driven in accordance with the driving signals, said hold memory circuit section including:

delay means for delaying the horizontal synchronization signal that has been supplied;

hold latch means for latching the display data in accordance with the horizontal synchronization signal that has been delayed by said delay means; and control means for outputting a display start signal to said switch circuit section, upon receipt of the horizontal synchronization signal that has been delayed by said delay means, said switch circuit section simultaneously outputting the driving signals in accordance with the display start signal.

13. The driving apparatus as set forth in claim 12, wherein:

said hold latch means is provided so as to be as many as the driving signals, and so as to be divided into a plurality of groups, one or more than one of said delay means are provided to every said group, and the horizontal synchronization signal is supplied to said hold latch means and corresponding delay means for each of the groups.

14. The driving apparatus as set forth in claim 13, wherein said control means receives the horizontal synchronization signal that has been delayed by said delay means corresponding to one of the groups.

15. The driving apparatus as set forth in claim 14, wherein:

when the respective groups have different number of delay means, said one of the groups is either one group including maximum number of corresponding delay means.

16. The driving apparatus as set forth in claim 12, wherein the display start signal is a signal indicating the period that the signal inputted to delay means is different from the signal outputted from delay means.

17. A display module comprising a driving apparatus and a display section that displays display data, said driving apparatus comprising:

a hold memory circuit section that latches display data, corresponding to one horizontal synchronization period, in accordance with an inputted horizontal synchronization signal; and a switch circuit section that outputs to a display section a plurality of driving signals into which the display data thus latched is converted by a conversion circuit, said display section being driven in accordance with the driving signals, said hold memory circuit section including:

delay means for delaying the horizontal synchronization signal that has been supplied;

hold latch means for latching the display data in accordance with the horizontal synchronization signal that has been delayed by said delay means; and control means for outputting a display start signal to said switch circuit section, upon receipt of the horizontal synchronization signal that has been delayed by said delay means, said switch circuit section simultaneously outputting the driving signals in accordance with the display start signal.

* * * * *